US009084046B2

(12) United States Patent
Ivey et al.

(10) Patent No.: US 9,084,046 B2
(45) Date of Patent: Jul. 14, 2015

(54) FLIP OUT DOG LEG MOUNTABLE CEILING SPEAKER ENCLOSURE

(71) Applicant: Mitek Corp., Inc., Phoenix, AZ (US)

(72) Inventors: Johnathan Ivey, Chandler, AZ (US); Michael Schomisch, Mesa, AZ (US); Kevin Sykes, Tempe, AZ (US); Michael Douglass Howell, Ennis, TX (US)

( * ) Notice: Subject to any disclaimer, the term of this patent is extended or adjusted under 35 U.S.C. 154(b) by 0 days.

(21) Appl. No.: 14/253,284

(22) Filed: Apr. 15, 2014

(65) Prior Publication Data

US 2014/0305734 A1 Oct. 16, 2014

Related U.S. Application Data

(60) Provisional application No. 61/812,375, filed on Apr. 16, 2013.

(51) Int. Cl.
*H04R 1/02* (2006.01)

(52) U.S. Cl.
CPC ..... *H04R 1/025* (2013.01); *H04R 2201/021* (2013.01)

(58) Field of Classification Search
CPC ..... H04R 1/02
USPC ..... 181/148, 150
See application file for complete search history.

(56) References Cited

U.S. PATENT DOCUMENTS

| | | | | |
|---|---|---|---|---|
| 5,331,119 | A * | 7/1994 | Leger et al. | 181/150 |
| 6,588,543 | B1 * | 7/2003 | Tchilinguirian | 181/150 |
| 7,003,129 | B2 * | 2/2006 | Hecht | 381/395 |
| 7,334,767 | B2 * | 2/2008 | Wright | 248/342 |
| 7,587,059 | B2 * | 9/2009 | Wright | 381/387 |
| 7,676,045 | B2 * | 3/2010 | Merrey et al. | 381/87 |
| 7,731,130 | B2 * | 6/2010 | Decanio et al. | 248/27.3 |
| 7,780,135 | B2 * | 8/2010 | Nelson et al. | 248/342 |
| 8,023,664 | B2 * | 9/2011 | Yang | 381/87 |
| 8,256,728 | B2 * | 9/2012 | Wright | 248/221.11 |
| 8,286,749 | B2 * | 10/2012 | Stewart et al. | 181/150 |
| 8,490,938 | B2 * | 7/2013 | Peng | 248/343 |
| 8,631,897 | B2 * | 1/2014 | Stewart et al. | 181/150 |
| 8,672,087 | B2 * | 3/2014 | Stewart et al. | 181/150 |
| 2004/0179710 | A1 * | 9/2004 | Farinelli et al. | 381/386 |
| 2007/0121988 | A1 * | 5/2007 | Merrey et al. | 381/386 |

* cited by examiner

*Primary Examiner* — Forrest M Phillips
(74) *Attorney, Agent, or Firm* — Keith L. Jenkins, Registered Patent Attorney, LLC; Keith L. Jenkins

(57) ABSTRACT

A manually operated flip dog mountable ceiling speaker enclosure, for ceiling or other panel installation, provides a plurality of flip dogs mounted tangentially on an annular flange around an opening of a speaker can and operated by either pulling on an actuator to create a cam-driven rotation to a radial alignment and a downward dog movement to a ratcheted clamping position, or by first rotating the manual actuator to rotate the dog and then pulling the actuator to pull the dog down into a ratcheted clamping position. Ratchet points on the dog are urged into ratchet points on a wall by a releasable biasing member. Three embodiments are illustrated.

20 Claims, 18 Drawing Sheets

FLIP OUT DOG LEG MOUNTABLE CEILING SPEAKER ENCLOSURE

RELATED APPLICATIONS

This application claims the benefit of U.S. provisional patent application Ser. No. 61/812,375 filed Apr. 16, 2013 to at least one common inventor.

TECHNICAL FIELD

This invention relates to providing a flip out dog leg mountable ceiling speaker enclosure. In particular, this invention relates to providing a manually installable flip out dog leg mountable ceiling speaker.

BACKGROUND

Installation of loudspeakers into panels, especially ceiling panels, presents unique challenges, especially in obtaining the desired balance between speed of installation and security of installation. Significantly, ceiling speaker installation in larger buildings can involve a thousand or more ceiling speakers, and the time it takes to install one ceiling speaker, multiplied a thousand times, becomes a noticeable factor in labor costs. A general class of devices used for ceiling speaker installation are "flip out dog legs" which clamp, or dog, a peripheral portion of ceiling panel between an annular flange and at least two dogs which are mounted peripherally around the speaker enclosure. Flip out dog legs are also known as "flip dogs". Flip dogs are initially stowed within the outer circumference of the hole in the ceiling panel in which the loudspeaker enclosure is to be mounted. In conventional operation, a screw device is used to "flip" the dog into a radially aligned position and lower the dog to the clamping position, requiring a screw driver for installation, usually a powered screw driver.

U.S. Pat. No. 8,286,749 discloses flip dogs that are screw-driven to deployment and combine the lowering action with the downward travel of the dog. Dismounting can be achieved by reversing the screw to exploit a vertical spring bias. U.S. Pat. No. 7,780,135 discloses screw-driven, vertical spring biased flip dogs of a different design, but similar functionality. US published patent application 20070121988 discloses yet another design for screw-driven, vertically spring-biased dogs.

Therefore, a need exists for a flip dog mountable ceiling speaker enclosure that does not require tools for activating the flip dogs. In addition, there is a need for a flip dog mountable ceiling speaker enclosure that can be more rapidly installed. There is also a need for a flip dog mountable ceiling speaker enclosure that can be fitted with a speaker by the user. There is also a need for a flip dog mountable ceiling speaker enclosure that can be dismounted. There is also a need for a flip dog mountable ceiling speaker enclosure in which all flip dogs on the flip dog mountable ceiling speaker enclosure can be deployed simultaneously.

OBJECTS AND FEATURES OF THE INVENTION

A primary object and feature of the present invention is to overcome the above-mentioned problems and fulfill the above-mentioned needs.

Another object and feature of the present invention is to provide a system that does not require tools for activating the flip dogs.

It is a further object and feature of the present invention to provide a system that can be more rapidly installed.

It is a further object and feature of the present invention to provide a system that can be dismounted.

It is a further object and feature of the present invention that it can be provided as a mountable enclosure to be fitted with a user's speaker.

It is a further object and feature of the present invention to provide a flip dog mountable ceiling speaker enclosure in which all flip dogs on the flip dog mountable ceiling speaker can be deployed simultaneously.

It is an additional primary object and feature of the present invention to provide such a system that is efficient, inexpensive and handy. Other objects and features of this invention will become apparent with reference to the following descriptions.

SUMMARY OF THE INVENTION

Hereinafter, the term "speakers" is used to mean "audio loudspeakers". The apparatus of the present invention provides a flip dog mountable speaker enclosure, with or without one or more speakers, that is installed rapidly and manually without tools, by providing an integrated actuator, such as a pull rod. The system comprises apparatus for clamping an inserted speaker enclosure to the periphery of a ceiling panel into which the speaker enclosure has been inserted. The system may also include a dismounting device. The system also includes spring-biased interlockable ratchet teeth.

More precisely, the invention provides a manually mountable ceiling speaker enclosure, including a speaker enclosure including an output end an annular support flange extending outwardly and perpendicularly from the output end; a plurality of flip dogs mounted on and spaced apart along the annular support flange near the speaker enclosure; where each flip dog has a dog having a first position tangent to the speaker enclosure; and a second position radial to the speaker enclosure and where the first position is distal the annular support flange and the second position is proximal the annular support flange; and a manual actuator operable, without tools, to move the dog from the first position to the second position. The manually mountable ceiling speaker enclosure, where the actuator may be operated by pulling the actuator away from the speaker enclosure. The manually mountable ceiling speaker enclosure, where the actuator may be operated by rotating the actuator. The manually mountable ceiling speaker enclosure, where the actuator may be releasable. The manually mountable ceiling speaker enclosure, where each dog of the plurality of flip dogs includes a barrel for receiving at least a portion of the actuator; a side-facing first ratchet portion including a linear array of upwardly pointed teeth extending from a middle portion of the barrel on a first side of the dog; a bridge portion extending from the barrel above the ratchet portion; and a foot extending from a distal end of the bridge portion and forming a notch between the ratchet portion and the foot. The manually mountable ceiling speaker enclosure, including a perimeter wall extending axially from the annular support flange between the plurality of flip dogs and spaced apart from an outer perimeter of the annular support flange; configured to fit within the notch when the dog is in the second position; and defining a perimeter for an installation opening in a ceiling panel. The manually mountable ceiling speaker enclosure, where each flip dog of the plurality of flip dogs includes first and second spaced apart and opposed sidewalls configured to engage respective first side and a second opposed side of the dog when the dog is in the second position; where the first sidewall includes a second ratchet portion including a linear array of downwardly pointed teeth configured to slidingly engage the barrel when the dog is in the first position and ratchetly engage the first ratchet portion when the dog is moved into the second position; and where the second wall includes a surface to slidingly engage the second side of the dog when the dog is moved into the second position. The manually mountable ceiling speaker enclosure, where the second wall supports a biasing member operable to urge the dog towards the second ratchet portion when the dog is moved into the second position. The manually mountable ceiling speaker enclosure, where the biasing member is releasably supported and each flip dog further includes a tool sleeve aligned to a release member of the releasably supported biasing member and configured to receive a tool for actuating the release member. The manually mountable ceiling speaker enclosure, where the second wall includes an arcuate top surface for engaging a portion of a bottom surface of the dog in the first position and operable to urge the dog into rotation responsive to a downward force. The manually mountable ceiling speaker enclosure, further including first and second supports operable to buttress the first and second sidewalls, respectively. The manually mountable ceiling speaker enclosure, further including a rear arcuate wall extending between the first and second sidewalls, and having an inner curvature conformal to the barrel. The manually mountable ceiling speaker enclosure, including at least one of a loudspeaker and a trim ring.

A manually mountable ceiling speaker enclosure, including a speaker enclosure having an output end an annular support flange extending outwardly and perpendicularly from the output end; a plurality of flip dogs mounted on and spaced apart along the annular support flange near the speaker enclosure; where each flip dog includes a dog having a first position tangent to the speaker enclosure and a second position radial to the speaker enclosure and where the first position is distal the annular support flange and the second position is proximal the annular support flange; and a manual actuator operable, without tools, to move the dog from the first position to the second position; and where the actuator may be manually operated by at least one of pulling the actuator away from the speaker enclosure and rotating the actuator. The manually mountable ceiling speaker enclosure, where the actuator may be releasable. The manually mountable ceiling speaker enclosure, where each dog of the plurality of flip dogs includes: a barrel for receiving a portion of the actuator; a side-facing first ratchet portion including a linear array of upwardly pointed teeth extending from a middle portion of the barrel on a first side of the dog; a bridge extending from the barrel above the ratchet portion; and a foot extending from a distal end of the bridge and forming a notch between the ratchet portion and the foot. The manually mountable ceiling speaker enclosure, including an annular wall extending axially from the annular support flange between the plurality of flip dogs and spaced apart from an outer perimeter of the annular support flange; and configured to fit within the notch when the dog is in the second position; and defining a perimeter for an installation opening in a ceiling panel. The manually mountable ceiling speaker enclosure, where each flip dog of the plurality of flip dogs includes: first and second spaced apart and opposed sidewalls configured to engage respective first side and a second opposed side of the dog when the dog is in the second position; where the first sidewall includes a second ratchet portion including a linear array of downwardly pointed teeth configured to slidingly engage the barrel when the dog is in the first position; and ratchetly engage the first ratchet portion when the dog is moved into the second position; and where the second wall: includes a surface to slidingly engage the second side of the dog when the dog is moved into the second position; supports a releasable biasing member operable to urge the dog towards the second ratchet portion when the dog is moved into the second position; includes a tool sleeve aligned to a release member of the releasably supported biasing member and configured to receive a tool for actuating the release member; and includes an arcuate top surface for engaging a portion of a bottom surface of the dog in the first position and operable to urge the dog into rotation responsive to a downward force; first and second supports operable to buttress the first and second sidewalls, respectively; and a rear arcuate wall extending between the first and second sidewalls, and having an inner curvature conformal to the barrel.

A manually mountable ceiling speaker enclosure, including: a speaker enclosure having an output end; an annular support flange extending outwardly and perpendicularly from the output end; a plurality of flip dogs mounted on and spaced apart on the annular support flange proximate the speaker enclosure; wherein each the flip dog further includes a dog having a first position tangent to the speaker enclosure; and a second position radial to the speaker enclosure and wherein the first position is distal the annular support flange and the second position is proximal the annular support flange; wherein each dog of the plurality of flip dogs includes: a barrel for receiving at least a portion of the actuator; a side-facing first ratchet portion including a linear array of upwardly pointed teeth extending from a middle portion of the barrel on a first side of the dog; a bridge extending from the barrel above the first ratchet portion; and a foot extending from a distal end of the bridge and forming a notch between the first ratchet portion and the foot; wherein each flip dog of the plurality of flip dogs includes: first and second spaced apart and opposed sidewalls configured to engage respective first side and a second opposed side of the dog when the dog is in the second position; wherein the first sidewall includes a second ratchet portion including a linear array of downwardly pointed teeth configured to: slidingly engage the barrel when the dog is in the first position; and ratchetly engage the first ratchet portion when the dog is moved into the second position; and wherein the second wall: includes a surface to slidingly engage the second side of the dog when the dog is moved into the second position; supports a releasable biasing member operable to urge the dog towards the second ratchet portion when the dog is moved into the second position; includes a tool sleeve aligned to a release member of the releasably supported biasing member and configured to receive a tool for actuating the release member; includes an arcuate top surface engaging a portion of a bottom surface of the dog in the first position and operable to urge the dog into rotation responsive to a downward force; first and second supports operable to buttress the first and second sidewalls, respectively; a rear arcuate wall extending between the first and second sidewalls, and having an inner curvature conformal to the barrel; a manual actuator operable, without tools, to move the dog from the first position to the second position; wherein the actuator may be manually operated by at least one of: pulling the actuator away from the speaker enclosure; and rotating the actuator; and an annular wall: extending axially from the annular support flange between the plurality of flip dogs and spaced apart from an outer perimeter of the annular support flange; configured to fit within the notch when the dog is in the second position; and defining a perimeter for an installation opening in a ceiling panel. The manually mountable ceiling speaker enclosure, wherein the actuator may be releasable.

BRIEF DESCRIPTION OF THE DRAWINGS

The present invention will hereinafter be described in conjunction with the following drawing figures, wherein like numerals denote like elements.

DETAILED DESCRIPTION OF THE INVENTION

The term "speaker" as defined and used herein refers to an audio loudspeaker. Directional modifiers such as "top", "bottom", and the like are oriented to the preferred ceiling installation of the flip dog mountable ceiling speaker enclosure 100 with the diaphragm 136 pointed down from the ceiling. Those of skill in the art, informed by the present disclosure, will appreciate that the flip dog mountable ceiling speaker enclosure 100 can also be mounted in walls, including slanted walls. "Dog" as defined and used herein refers to a securing element, such as a clamping element, as in the nautical "Dog down that hatch!"

Figure 1:
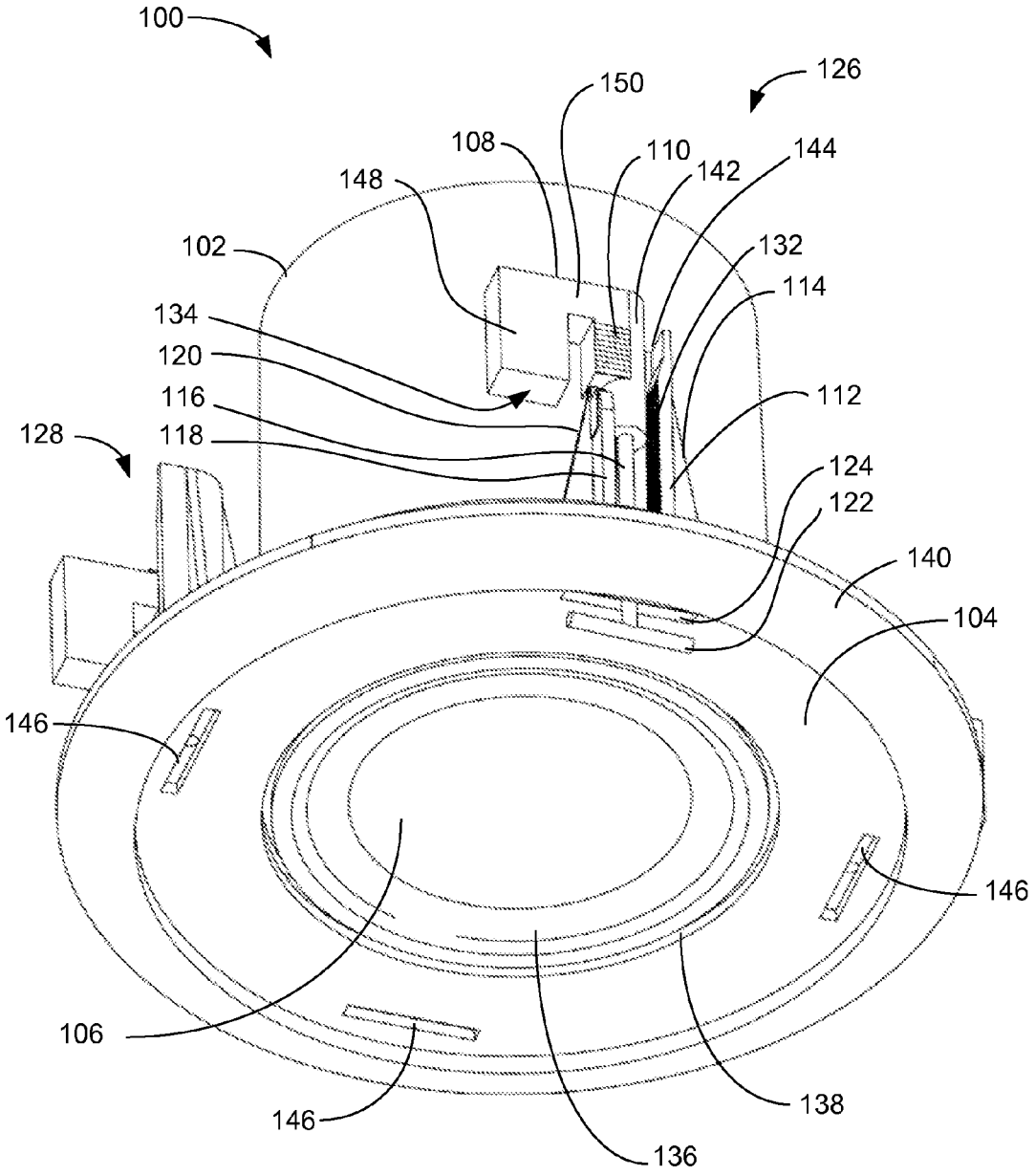
FIG. 1 is a bottom front perspective view illustrating an exemplary embodiment of a flip dog mountable ceiling speaker enclosure, according to a preferred embodiment of the present invention.

FIG. 1 is a bottom front perspective view illustrating an exemplary embodiment of a flip dog mountable ceiling speaker enclosure 100, according to a preferred embodiment of the present invention. Flip dog mountable ceiling speaker enclosure 100 includes a speaker enclosure 102, or "can" 102 that, in this embodiment contains a loudspeaker having a surround 138, diaphragm 136, and dust cap 106, all in an output end of the enclosure 102. In various embodiments, speaker enclosure 102 may be sold without a loudspeaker and with various respective internal fittings for a various respective loudspeakers or arrays of loudspeakers. Speaker enclosure 102 is fixed to an annular support flange 104 that surrounds the output end of speaker enclosure 102, and extends radially outward from the speaker enclosure 102, as shown. While the enclosure 102 is illustrated and described as having a circular cross-section, other cross-sectional shapes are within the scope of the invention, and so the annular support flange 104, for example, may be generalized as a perimetrical support flange 104. In a particular embodiment, speaker enclosure 102 and annular support flange 104 may be made of one piece. An annular trim ring 140 is fixed to the underside of annular support flange 104. The top side of annular support flange 104 supports flip dogs 126 and 128, among others not visible in this view. A flip dog mountable ceiling speaker enclosure 100, that is sold without a speaker as a mountable enclosure 102 for one or more user-supplied speakers, is within the scope of the present invention. While the speaker enclosure 102 is exemplified as generally a circular cylinder, various other shapes are within the scope of the present invention.

Flip dog 126 is shown in the stowed position, or first position, before deployment, in which dog 108 is turned tangent to the curvature of speaker enclosure 102 to enable the flip dog mountable ceiling speaker enclosure 100 to be inserted easily into a hole in a ceiling panel. Flip dog 126 includes dog 108 with a linear array of upward-pointed ratchet teeth 110 extending from the barrel 142, a foot 148, and a bridge 150 between the barrel 142 and the foot 148. Flip dog 126 also includes a manual actuator, illustrated as pull rod 116. extending through an opening 124 to end in a handle 122; buttressed 114 first sidewall 112 with downward-pointed ratchet teeth 132; buttressed second sidewall 118 with curved portion for rotating the dog 108; and releasable biasing member 212, illustrated as leaf spring 212 (see FIG. 2). Handle 122 is shown in the stowed and shipped position, spaced apart from opening 124 so that an installer may easily grasp the handle 122. Dog 108 includes a barrel 142 within which pull rod 116 can freely rotate and slide upwardly. Pull rod 116 need not be completely rigid, but should have enough stiffness to be both pulled and pushed. The top end of pull rod 116 has a larger diameter knob 404 (See FIGS. 10 and 4) that, prior to deployment, nests in a socket 406 (see FIG. 4) proximate the top of the barrel 142 of dog 108. When handle 122 is pulled downward by the installer, knob 404 exerts force on the floor of socket 406 to pull the dog 108 into a deployed position. Flip dog 128 is shown in a deployed position. Once the dog 108 is pulled down, the pull rod 116 is pushed upward by the installer into opening 124, as shown with handles 146, which are the same as handle 122, but deployed. Handles 122 and 146 may be made of a resilient plastic and sized to snap into openings 124 so that handles 122 and 146 are retained. The flip dog mountable ceiling speaker enclosure 100 is exemplified in the drawings as having four flip dogs 126, 128, 202, and 402 (see FIG. 4). In various additional embodiments, two or more flips dogs 126, 128, 202, or 402 may be used, with the usual, but non-limiting, number between two and five.

First sidewall 112 of flip dog 126 has a linear array of downward pointing ratchet teeth 132 that are sized complimentarily to upward pointing ratchet teeth 110 on dog 108. By pulling down on the handle 122, dog 108 is constrained to rotate outward and move downward such that upward-pointed ratchet teeth 110 of dog 108 engage downward pointing ratchet teeth 132 of first sidewall 112, enabling dog 108 to move downward to engage the ceiling panel with bottom dog surface 134 but not allowing dog 108 to move upward thereafter. The upper end 144 of first sidewall 112 is thinner to allow dog 108 to gain initial momentum before upward-pointing ratchet teeth 110 engage downward-pointing ratchet teeth 132. Gap 222 (see FIG. 2) provides a non-engagement area for upward-pointing ratchet teeth 110 when flip dog 108 is initially rotated into radial alignment. First sidewall 112 is buttressed by support 114. Second sidewall 118 is buttressed by support 120. Supports 114 and 120 may be of various shapes in various embodiments. First and second sidewalls 112 and 118 constrain the motion of dog 108 to initially rotational and then downward motion.

Figure 2:
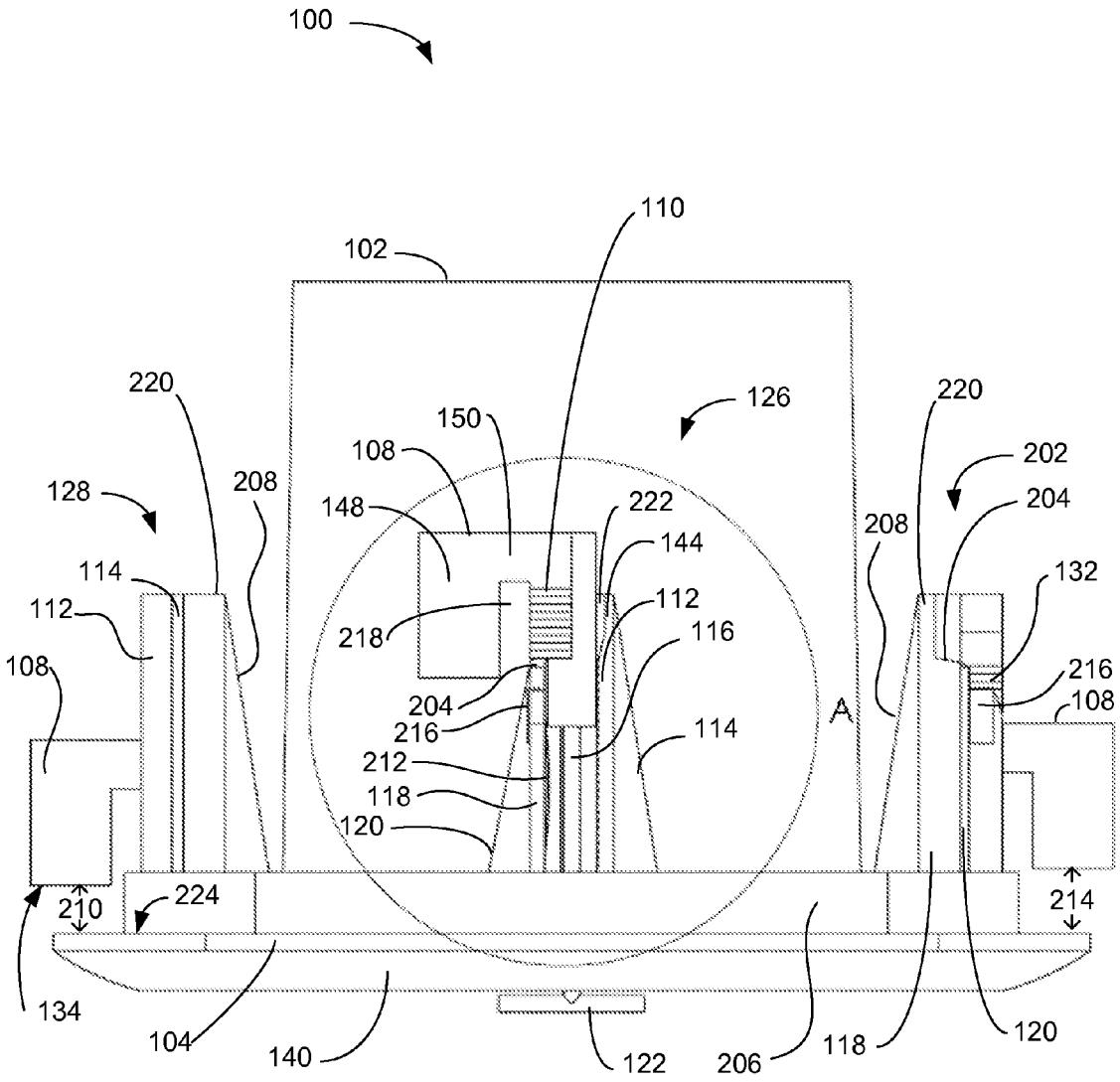
FIG. 2 is a front elevation view illustrating the exemplary embodiment of the flip dog mountable ceiling speaker enclosure of FIG. 1, defining a detail area "A", according to a preferred embodiment of the present invention.

FIG. 2 is a front elevation view illustrating the exemplary embodiment of the flip dog mountable ceiling speaker enclosure 100 of FIG. 1, defining a detail area "A", according to a preferred embodiment of the present invention. Flip dog 128, of the same construction as flip dog 126, is shown in a fully deployed condition, clamping a ceiling panel (not shown) in gap 210 between bottom surface 134 of foot 148 of dog 108 and top surface 224 of annular support flange 104. Likewise, flip dog 202 is shown in a deployed position clamping a ceiling panel (not shown) in gap 214, illustrating the ability of the flip dog mountable ceiling speaker enclosure 100 to adapt to unevenness in ceiling panel thickness. The handles 146 for flip dogs 128 and 202 are snapped into openings 124 (See FIG. 1).

Second sidewall 118 has a curved, or arcuate, top edge shoulder 204 to rotate, or flip, dog 108 towards radial alignment as dog 108 is pulled downward. Radial outward of support 120, second sidewall 118 has a second shoulder that is initially flat and thin for holding the clip 216 of biasing member 212, illustrated as leaf spring 212. Clip 216 also serves as a release member for releasable leaf spring 212. Leaf spring 212 urges the dog 108 toward engagement between ratchet teeth 110 and 132 as the dog 108 is pulled downward. Second sidewall 118 extends into arcuate rear wall 220 which, in turn, extends into first side wall 112. Rear wall 220 has an internal radius of curvature adapted to enable sliding rotation of the barrel portion 142 of dog 108. Rear wall 220 is buttressed by support 208.

Circumferential wall 206 is supported by annular support flange 104 and is outside the stowed flip dog 126 but deployed flip dogs 128 and 202 extend over circumferential wall 206 by virtue of notch 218 (one of three labeled). Circumferential wall 206 has an outer radius that defines the size of the hole to be made in the ceiling panel for insertion of the flip dog mountable ceiling speaker enclosure 100. Preferably, circumferential wall 206 has a height slightly higher than the thickness of the ceiling panel into which flip dog mountable ceiling speaker enclosure 100 is to be mounted. In embodiments in which the enclosure 102 does not have a circular cross-section, the circumferential wall 206 follows the shape of the enclosure 102 to be a perimetrical wall 206.

Figure 3:
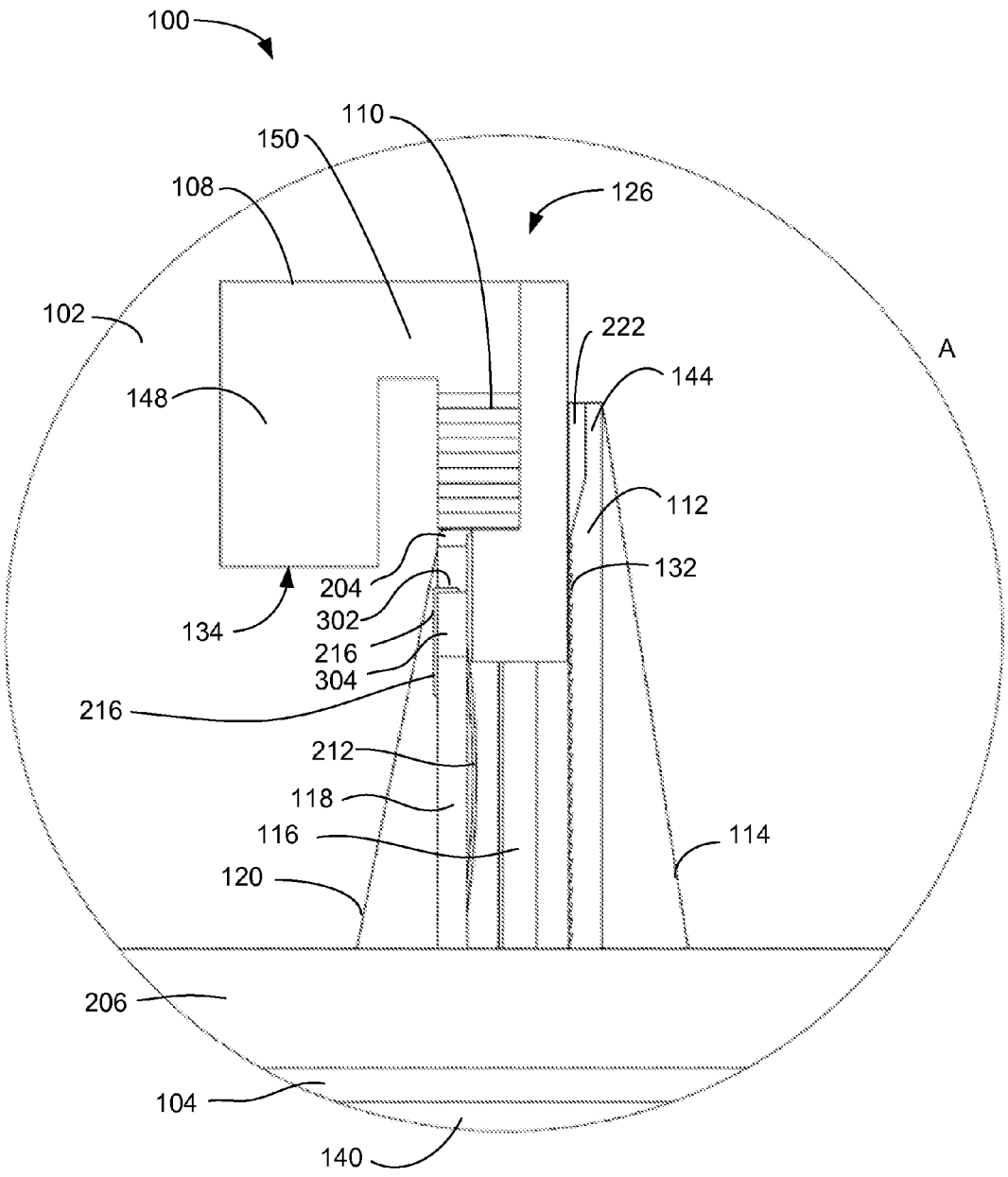
FIG. 3 is a front elevation view illustrating the detail "A", defined in FIG. 2, of the exemplary flip dog mountable ceiling speaker enclosure of FIG. 1, according to a preferred embodiment of the present invention.

FIG. 3 is a front elevation view illustrating the detail "A", defined in FIG. 2, of the exemplary flip dog mountable ceiling speaker enclosure 100 of FIG. 1, according to a preferred embodiment of the present invention. The top portion 302 of the clip portion 216 of leaf spring 212 extends over a thin portion of second sidewall 118 to extend downward to complete leaf spring 212. Second sidewall 118 has a downward sloping portion 304 at full thickness that ends at the vertical front face of second sidewall 118.

Figure 4:
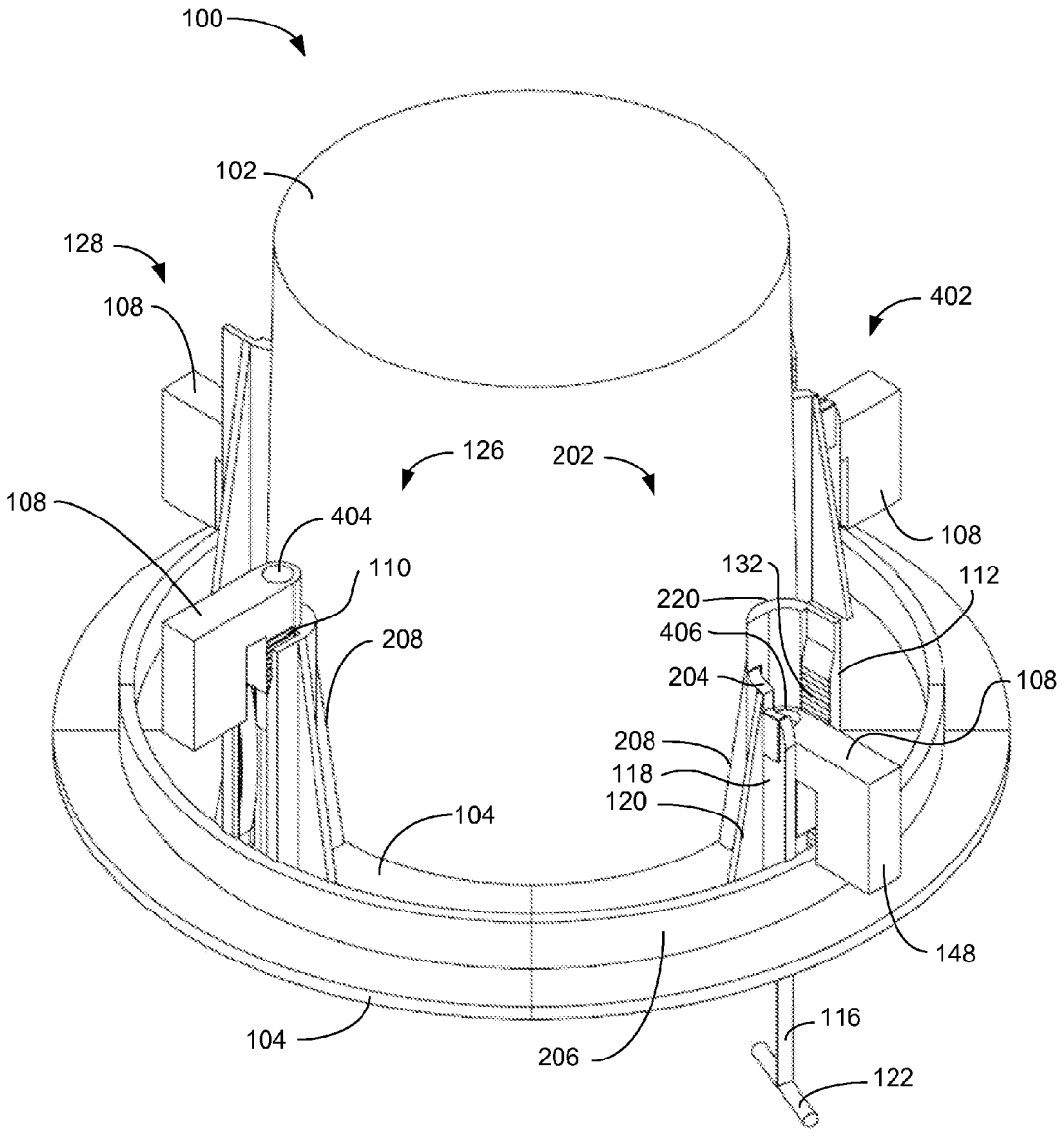
FIG. 4 is a top side perspective view illustrating the exemplary embodiment of the flip dog mountable ceiling speaker enclosure of FIG. 1, according to a preferred embodiment of the present invention.

FIG. 4 is a top side perspective view illustrating the exemplary embodiment of the flip dog mountable ceiling speaker enclosure 100 of FIG. 1, according to a preferred embodiment of the present invention. Dog 108 of flip dog 126 has been rotated into radial alignment as it is initially pulled down. Flip dog 202 has been pulled down via handle 122 and pull rod 116, but pull rod 116 has not yet been pushed back up to snap handle 122 into opening 124 (see FIG. 1). Flip dogs 128 and 402 are fully deployed. Socket 406 is illustrated in regard to flip dog 202, while knob 404 can be seen in flip dog 126. Socket 406 is deeper than knob 404 is high. The illustration of flip dog 202 shows a minute portion of knob 404 in socket 406, which is too small to take a lead line in this drawing.

Figure 5:
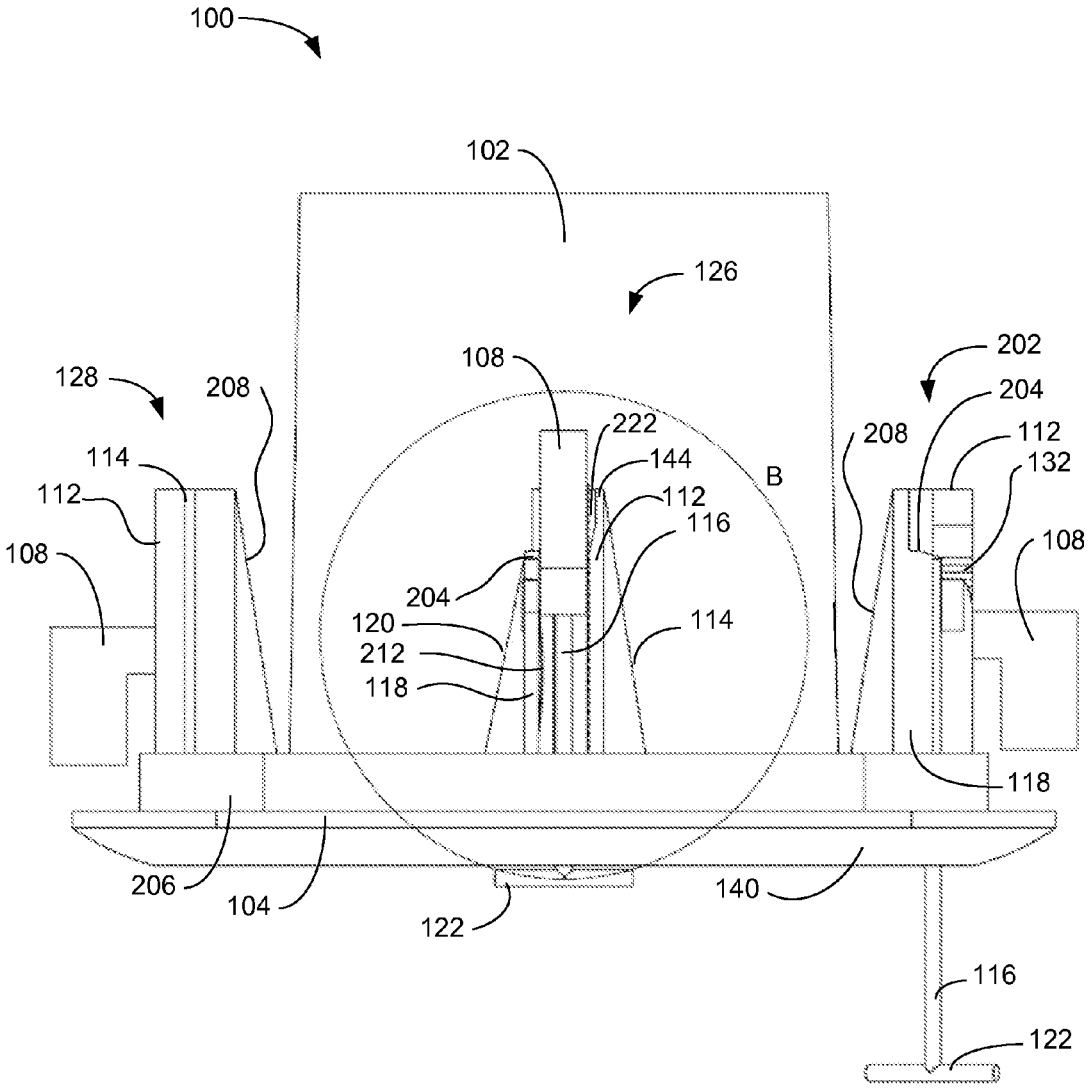
FIG. 5 is a front elevation view illustrating the exemplary embodiment of the flip dog mountable ceiling speaker of FIG. 1, defining a detail area "B", according to a preferred embodiment of the present invention.

FIG. 5 is a front elevation view illustrating the exemplary embodiment of the flip dog mountable ceiling speaker enclosure 100 of FIG. 1, defining a detail area "B", according to a preferred embodiment of the present invention. Flip dog 126 is shown rotated to the radially aligned position. Flip dog 128 is shown fully deployed and flip dog 202 is shown pulled down but without handle 122 stowed.

Figure 6:
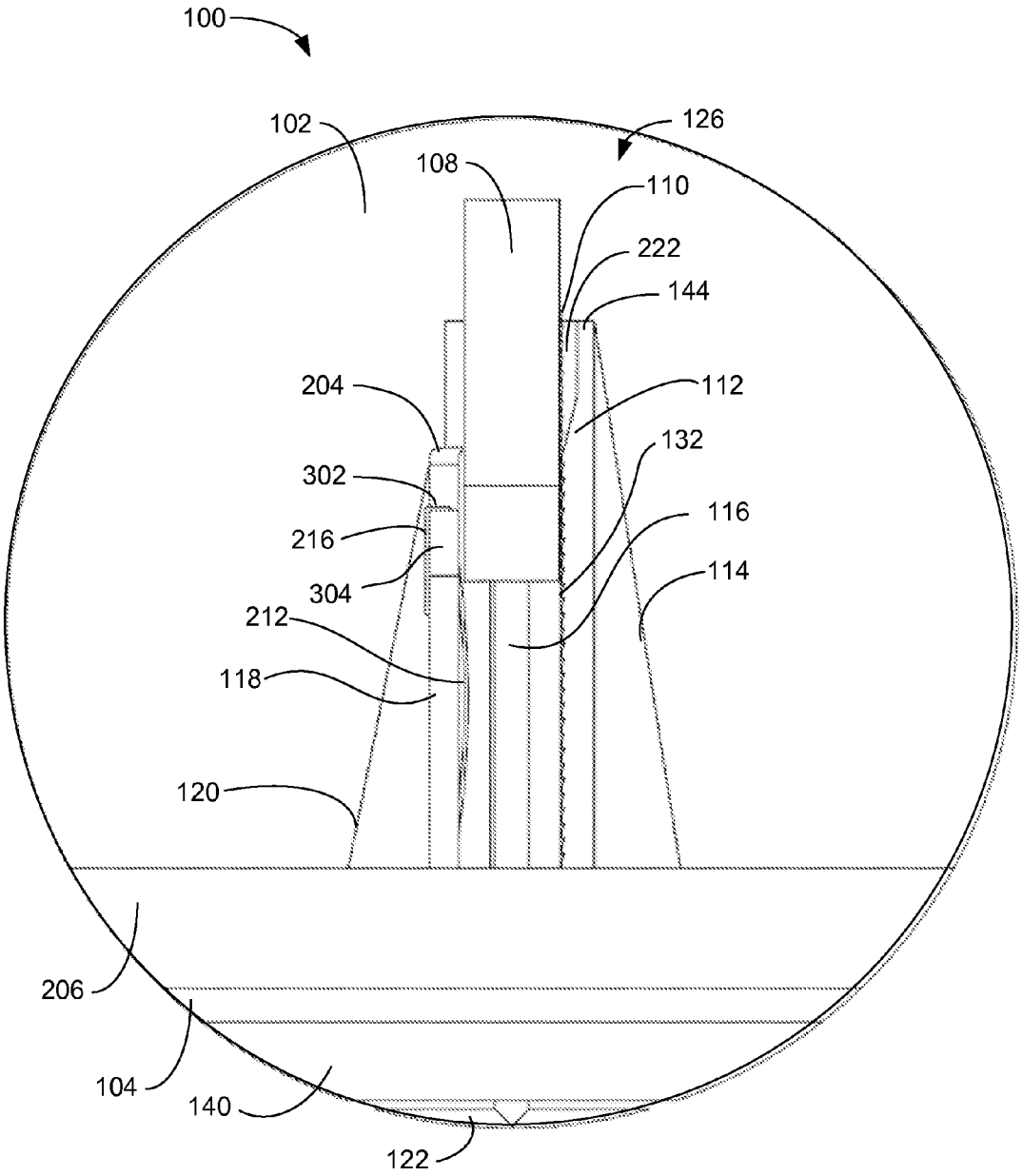
FIG. 6 is a front elevation view illustrating the detail "B", defined in FIG. 5, of the exemplary embodiment of the flip dog mountable ceiling speaker enclosure of FIG. 1, according to a preferred embodiment of the present invention.

FIG. 6 is a front elevation view illustrating the detail "B", defined in FIG. 5, of the exemplary embodiment of the flip dog mountable ceiling speaker enclosure 100 of FIG. 1, according to a preferred embodiment of the present invention. Upward-pointing teeth 110 on dog 108 have not yet engaged downward-pointing teeth on first sidewall 112 but are in gap 222 and, therefore, not engaged.

Figure 7:
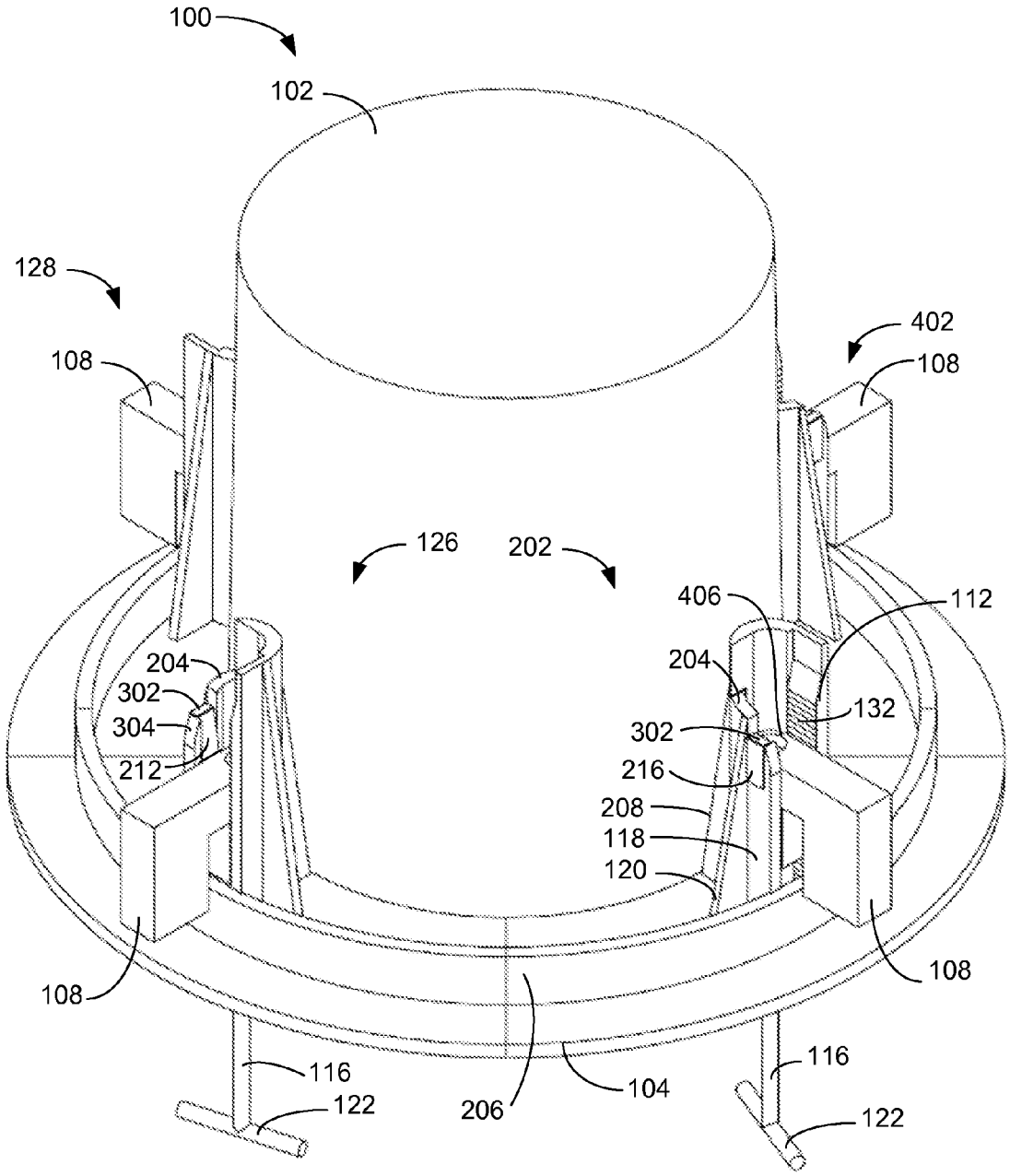
FIG. 7 is a top side perspective view illustrating the exemplary embodiment of the flip dog mountable ceiling speaker enclosure of FIG. 1, according to a preferred embodiment of the present invention.

FIG. 7 is a top side perspective view illustrating the exemplary embodiment of the flip dog mountable ceiling speaker enclosure 100 of FIG. 1, according to a preferred embodiment of the present invention. The relationship of top portion 302 of the clip portion 216 of leaf spring 212 can be more clearly seen in regard to flip dog 126 and 202. Flip dogs 126 and 128 are shown in the pulled down position but the handles 122 for flip dogs 126 and 128 have not been snapped into openings 124 (see FIG. 1). Flip dogs 128 and 402 are deployed, but their handles 122 cannot be seen in this view. In an additional embodiment, all four handles 122 (corresponding to the four flip dogs 126, 128, 202, and 402) may be joined by a removable and reusable jig or installation tool, such that all four handles 122 may be pulled down at once and preferably pushed up at once. In a particular embodiment, pull rods 116 are long enough and flexible to enable that an installer can grasp all four handles 122 to pull all four handles 122 down concurrently. Variations in the shape of dogs 108, consistent with strength and functional requirements, are within the scope of the present invention.

Figure 8:
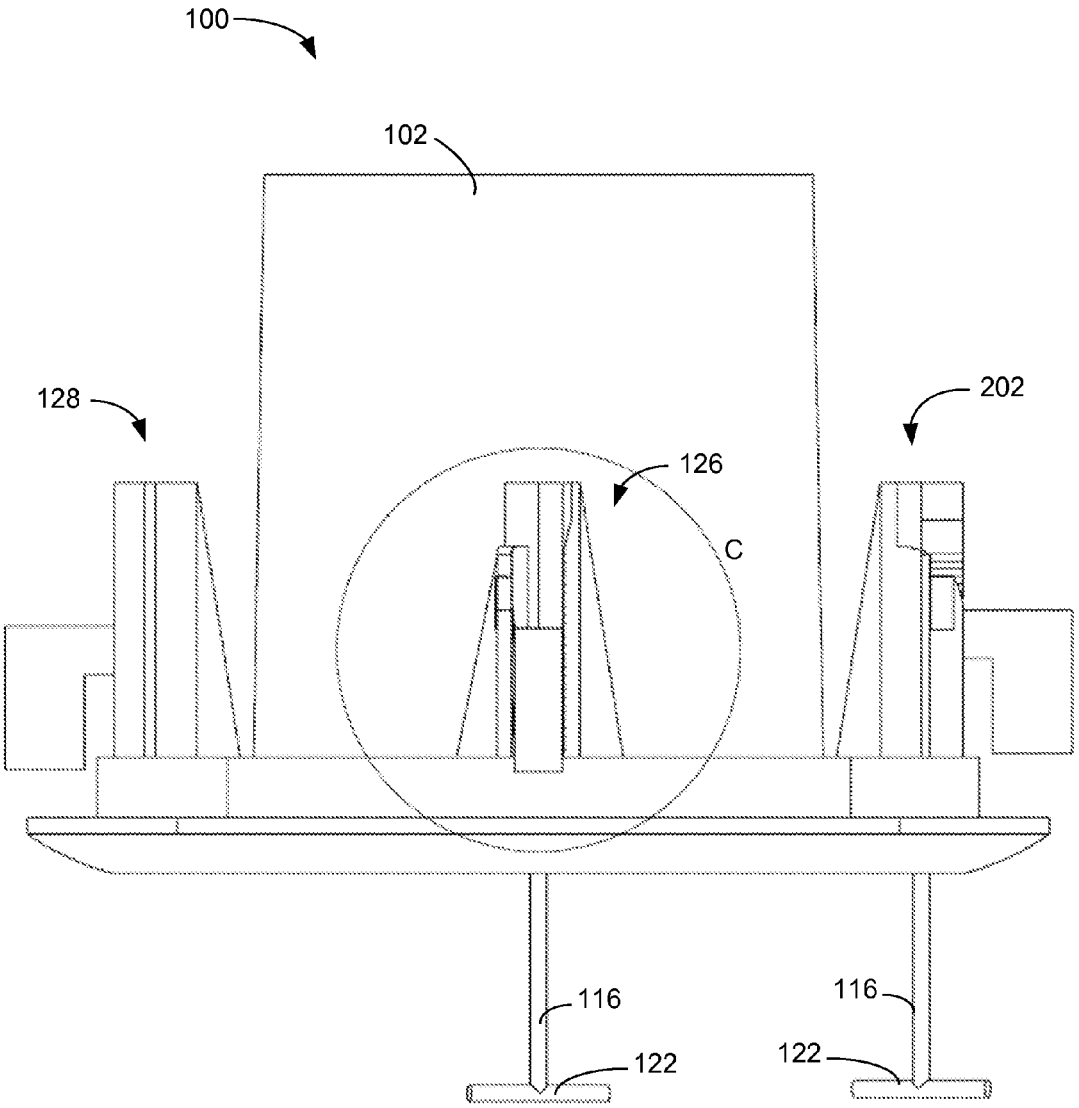
FIG. 8 is a front elevation view illustrating the exemplary embodiment of the flip dog mountable ceiling speaker enclosure of FIG. 1 and defining detail "C", according to a preferred embodiment of the present invention.

FIG. 8 is a front elevation view illustrating the exemplary embodiment of the flip dog mountable ceiling speaker enclosure 100 of FIG. 1 and defining detail "C", according to a preferred embodiment of the present invention. Flip dog 126 is illustrated as having been pulled completely down, as have flip dogs 128 and 202. Flip dog 128 is completely deployed, with its handle 122 snapped into opening 124 (see FIG. 1). The handles 122 for flip dogs 126 and 202 are shown as not yet stowed.

Figure 9:
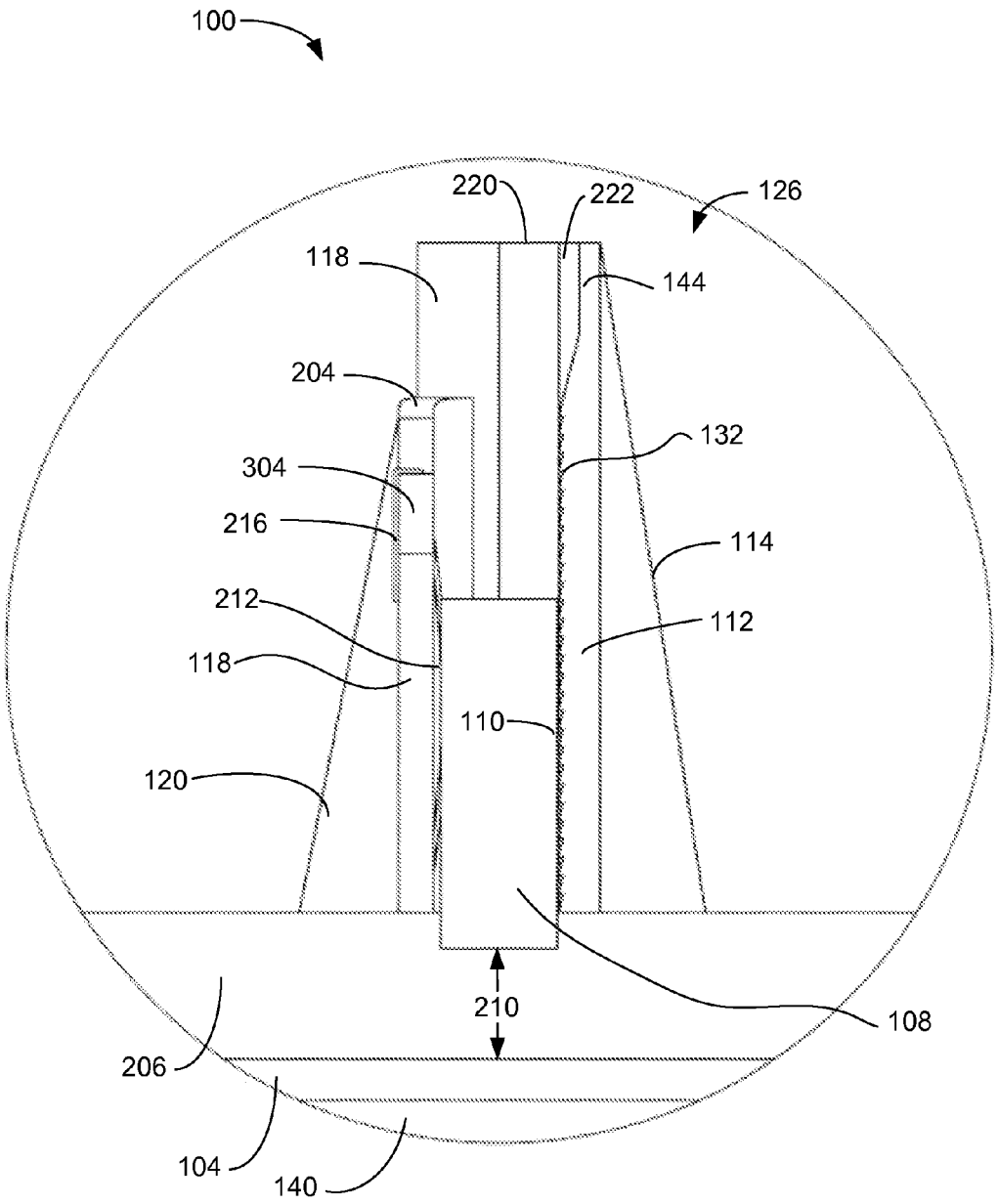
FIG. 9 is a front elevation view illustrating the detail "C", defined in FIG. 8, of the exemplary embodiment of the flip dog mountable ceiling speaker enclosure of FIG. 1, according to a preferred embodiment of the present invention.

FIG. 9 is a front elevation view illustrating the detail "C", defined in FIG. 8, of the exemplary embodiment of the flip dog mountable ceiling speaker enclosure 100 of FIG. 1, according to a preferred embodiment of the present invention. Upward-pointing teeth 110 on dog 108 are engaged at the bottom of the downward-pointing teeth 132 of the first side wall 112. Various shapes of supports 120, 114, and 208, consistent with the support requirements, are within the scope of the present invention.

Figure 10:
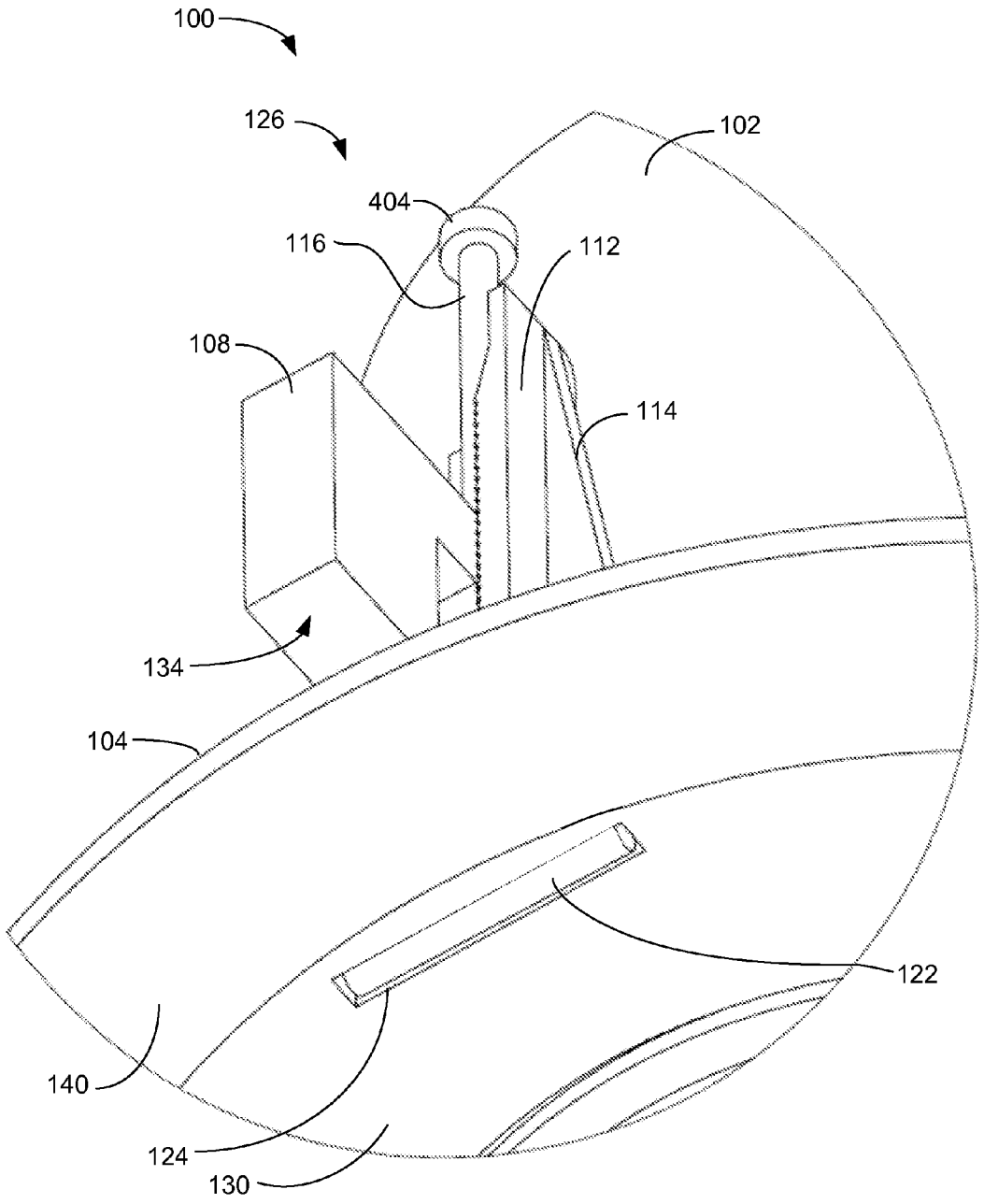
FIG. 10 is a bottom front perspective view illustrating an exemplary embodiment of the flip dog mountable ceiling speaker enclosure, according to a preferred embodiment of the present invention.

FIG. 10 is a bottom front perspective view illustrating an exemplary embodiment of the flip dog mountable ceiling speaker enclosure 100 of FIG. 1, according to a preferred embodiment of the present invention. Knob 404 can be clearly seen on the top of pull rod 116 knob as a right circular cylinder to permit rotational motion within socket 406. Dog 108 has been completely pulled down and pull rod 116 has been pushed upward, snapping handle 122 into opening 124 and revealing knob 404. Handles 122 of various shapes and sizes, consistent with ease of operation and above-described functionality, are within the scope of the present invention.

Figure 11:
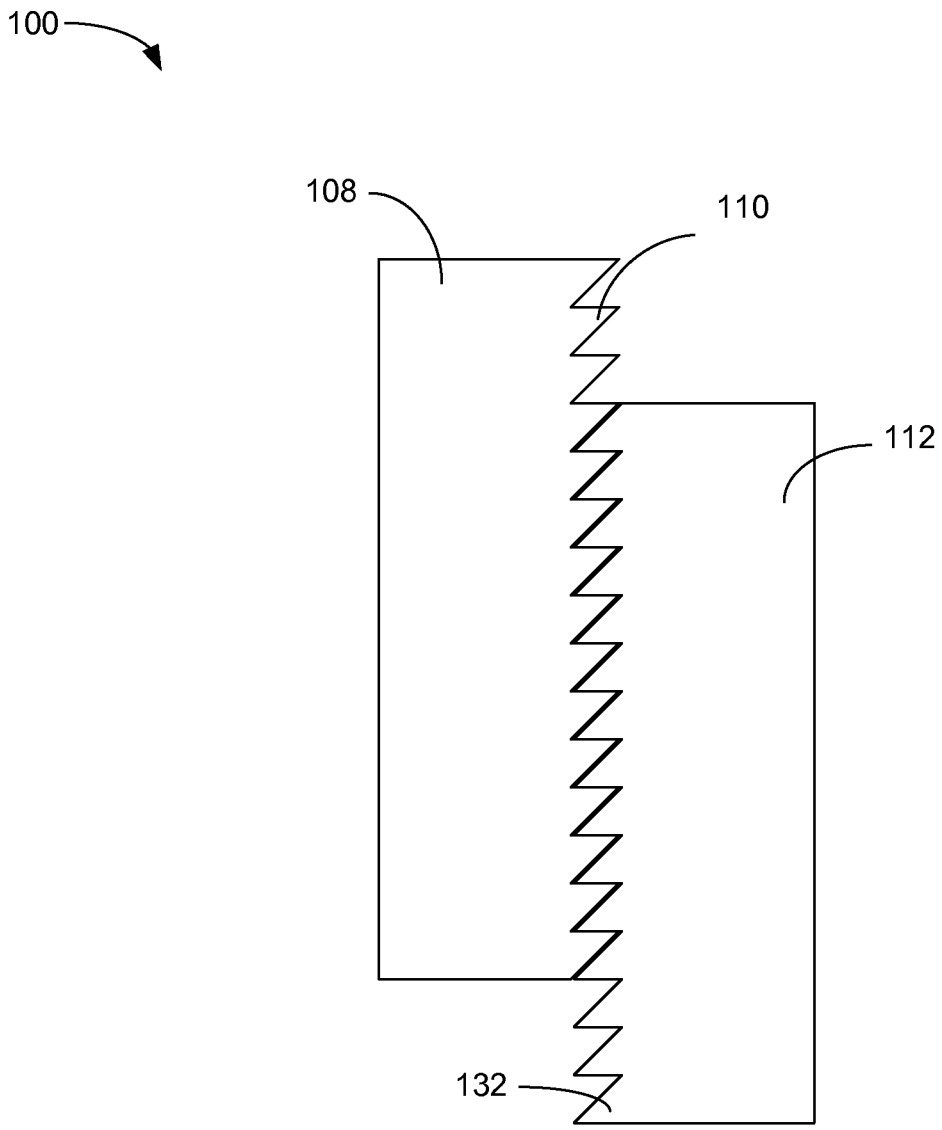
FIG. 11 is a diagrammatic side elevation view illustrating the exemplary interlocking ratchet teeth of the exemplary embodiment of the flip dog mountable ceiling speaker enclosure, according to a preferred embodiment of the present invention.

FIG. 11 is a diagrammatic side elevation view illustrating the exemplary interlocking ratchet teeth 110 and 132 of the exemplary embodiment of the flip dog mountable ceiling speaker enclosure 100 of FIG. 1, according to a preferred embodiment of the present invention. A portion of dog 108 is shown with upward-pointing teeth 110 engaging downward-pointing teeth 132 of a portion of first sidewall 112. Ratchet teeth 110 and 132 are preferably made of a resilient material, such as that used for zip ties. Leaf spring 212 urges dog 108 toward first sidewall 112, but allows point-to point contact of the teeth to compress leaf spring 212 to permit downward motion of dog 108.

Figure 12:
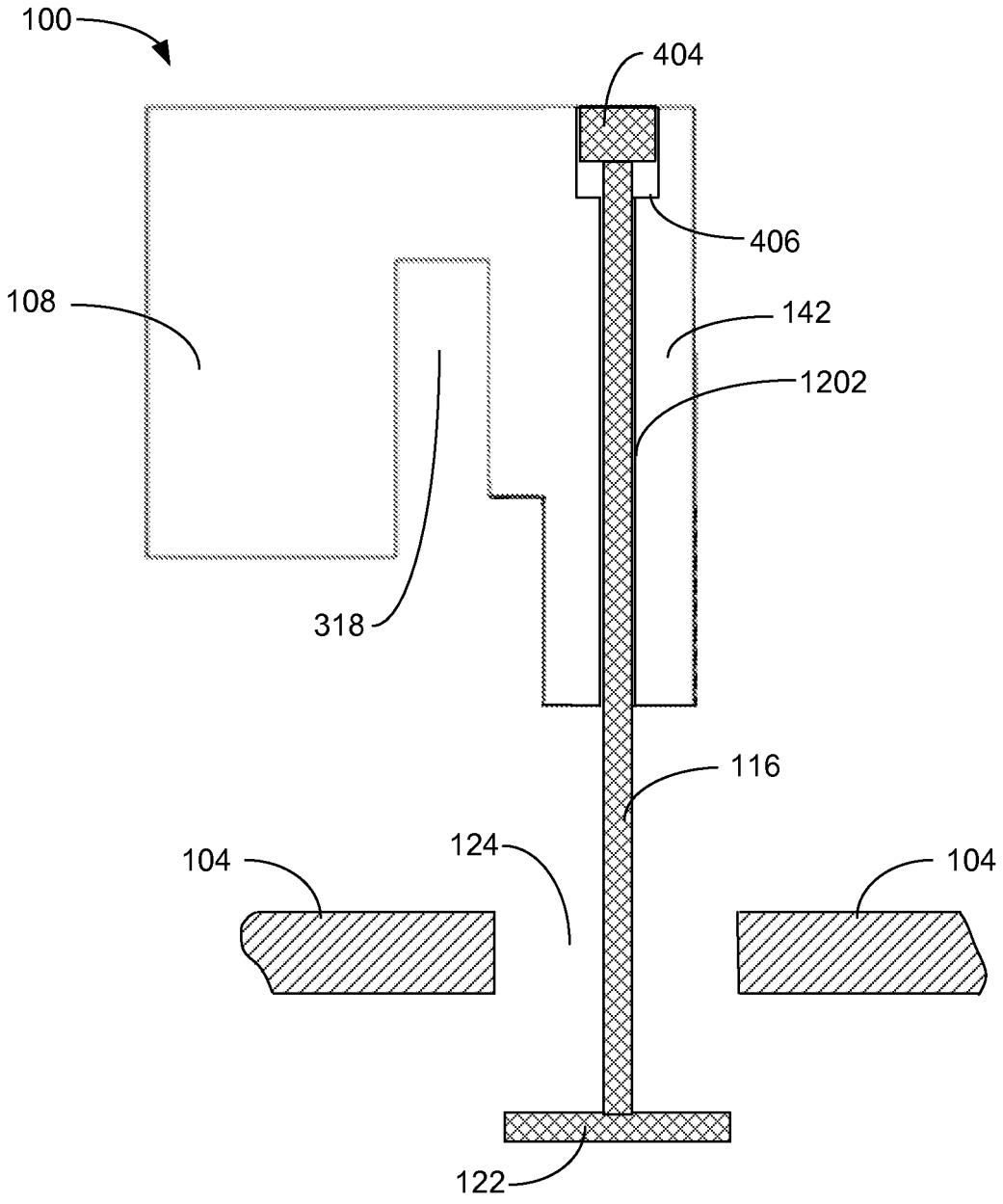
FIG. 12 is a diagrammatic side cross-sectional view illustrating the exemplary dog and pull rod of the exemplary embodiment of the flip dog mountable ceiling speaker enclosure, according to a preferred embodiment of the present invention.

FIG. 12 is a diagrammatic side cross-sectional view illustrating the exemplary dog 108 and pull rod 116 of the exemplary embodiment of the flip dog mountable ceiling speaker enclosure 100, according to a preferred embodiment of the present invention. The barrel 142 of dog 108 includes a through bore 1202 in which pull rod 116 translates and rotates freely. Knob 404 is positioned at the top of pull rod 116, and may be attached by screwing onto pull rod 116 or other conventional means. Knob 404 translates and rotates in socket 406. Pull rod 116 extends through opening 124 in annular support flange 104 and terminates in handle 122. When handle 122 is pulled downward, the bottom surface of knob 404 meets the floor surface of socket 406 and dog 108 is moved downward thereby.

Figure 13:
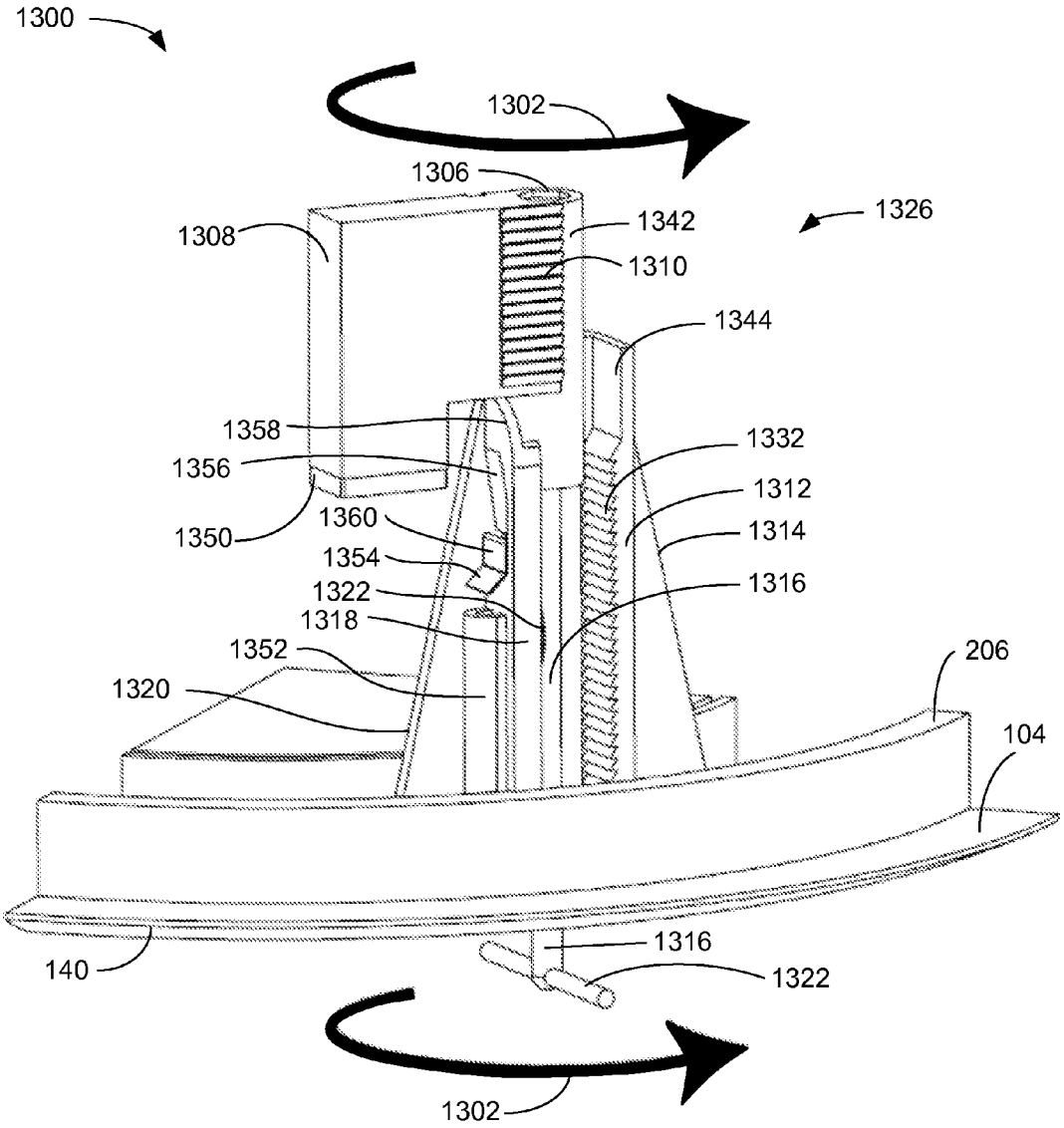
FIG. 13 is a front perspective view illustrating an exemplary second embodiment of a flip dog of the flip dog mountable ceiling speaker enclosure shown in a first deployment state, according to a preferred embodiment of the present invention.

FIG. 13 is a front perspective view illustrating an exemplary second embodiment of a flip dog 1328 of the flip dog mountable ceiling speaker enclosure 1300 shown in a first deployment state, according to a preferred embodiment of the present invention. Flip dog mountable ceiling speaker enclosure 1300 is similar in most respects to flip dog mountable ceiling speaker enclosure 100. In this additional embodiment, pull rod 1316 does not rotate in the bore (not visible in this view, but similar to bore 1202) within the barrel 1342 of the dog 1308. Socket 1306 in dog 1308 is hexagonal, and the knob of pull rod 1316 is of the same shape and of complimentary size. Pull rod 1316 is substantially rigid in torsion, enabling an installer to rotate 1302 handle 1322 to transmit a torque to flip dog 1308 to rotate 1302 dog 1308 from the tangentially aligned, or stowed, position, as shown, to the radially aligned position shown in FIG. 14. Dog 1308 has upward-pointing ratchet teeth 1310 for engaging downward-pointing ratchet teeth 1332 on first sidewall 1312. Dog 1308 also has a resilient contact piece 1350.

First sidewall 1312 has a thin portion 1344 for creating an area of non-engagement for upward-pointing ratchet teeth 1310 and also has a buttressing support 1314. Second sidewall 1318 has a buttressing support 1320. Second sidewall 1318 also has a rod sleeve 1352 for assisting in dismounting flip dog mountable ceiling speaker enclosure 1300. Second sidewall 1318 has an arched top 1358 defining an opening 1356 there below. Leaf spring 1322 is installed on the inside of second sidewall 1318 at the bottom of opening 1356 by means of a clip 1360 over a narrow portion of second sidewall 1318. Outward sloping extension 1354 of clip 1360 assists in removal of leaf spring 1322 in dismounting the flip dog mountable ceiling speaker enclosure 1300 from a ceiling panel. Removing leaf spring 1322 enables upward-pointing ratchet teeth 1310 to disengage from downward-pointing ratchet teeth 1332, allowing dog 1308 to be raised and stowed by means of handle 1322. Leaf spring 1322 can be removed by inserting a tool, such as a rod, into tool sleeve 1352 from below and engaging and pushing up on outward sloping extension 1354 of clip 1360 of leaf spring 1322.

Figure 14:
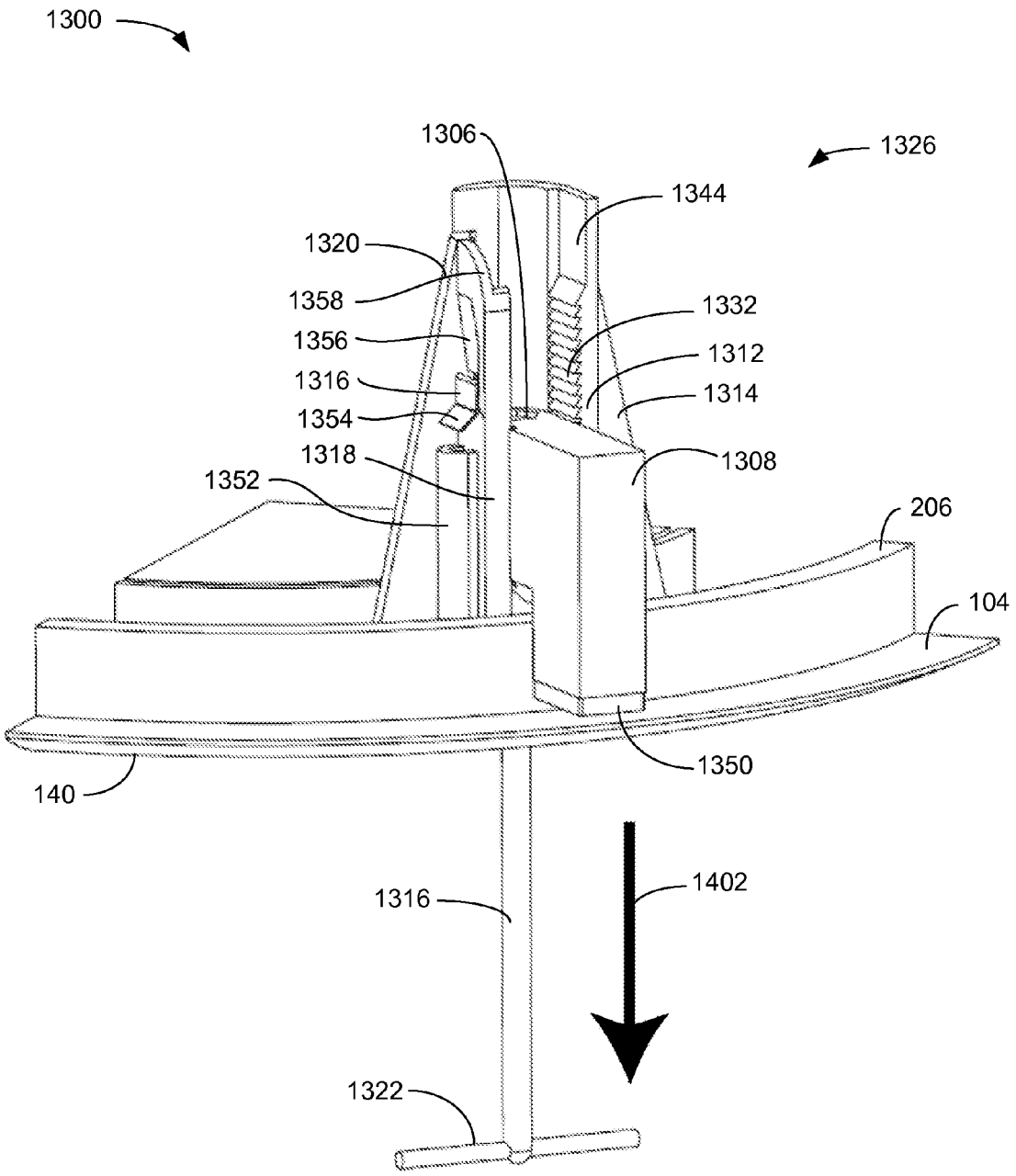
FIG. 14 is a front perspective view illustrating the exemplary second embodiment of a flip dog of FIG. 13 of the flip dog mountable ceiling speaker enclosure shown in a second deployment state, according to a preferred embodiment of the present invention.

FIG. 14 is a front perspective view illustrating the exemplary second embodiment of a flip dog 1326 of FIG. 13 of the flip dog mountable ceiling speaker enclosure 1300 shown in a second deployment state, according to a preferred embodiment of the present invention. After turning the dog 1308 to the radially aligned position, the installer pulls down 1402 on handle 1322 to force dog 1308 into a clamping position opposite annular support flange 104, as shown. The dual action approach of FIG. 14 has the disadvantage of not enabling concurrent activation of all flip dogs 1326.

Figure 15:
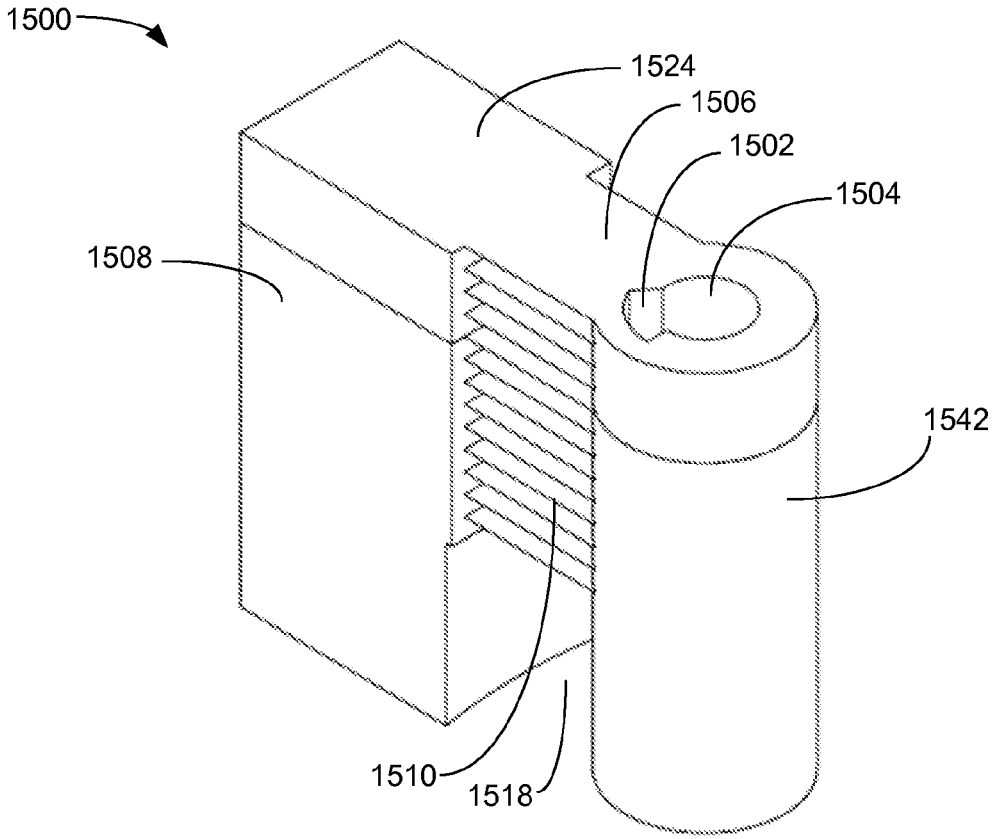
FIG. 15 is a front-top perspective view illustrating an exemplary third embodiment of a flip dog, according to a preferred embodiment of the present invention.

FIG. 15 is a front-top perspective view illustrating an exemplary third embodiment of a dog 1500, according to a preferred embodiment of the present invention. Dog 1500 accommodates removable actuator 1900 (see FIG. 19), has ratchet teeth 1510 off the barrel 1542 and onto the bridge 1506, and has a smaller notch 1518 for another embodiment of a flip dog mountable ceiling speaker enclosure. Those of skill in the art, enlightened by the present disclosure, will appreciate the modifications to flip dogs 100 or 1300 needed to accommodate dog 1500. Barrel opening 1504 has an internal groove 1502 that will receive a key 1902 (see FIG. 19) on actuator 1900 to rotate dog 1500 into a deployed position before the dog 1500 is pulled down.

Figure 16:
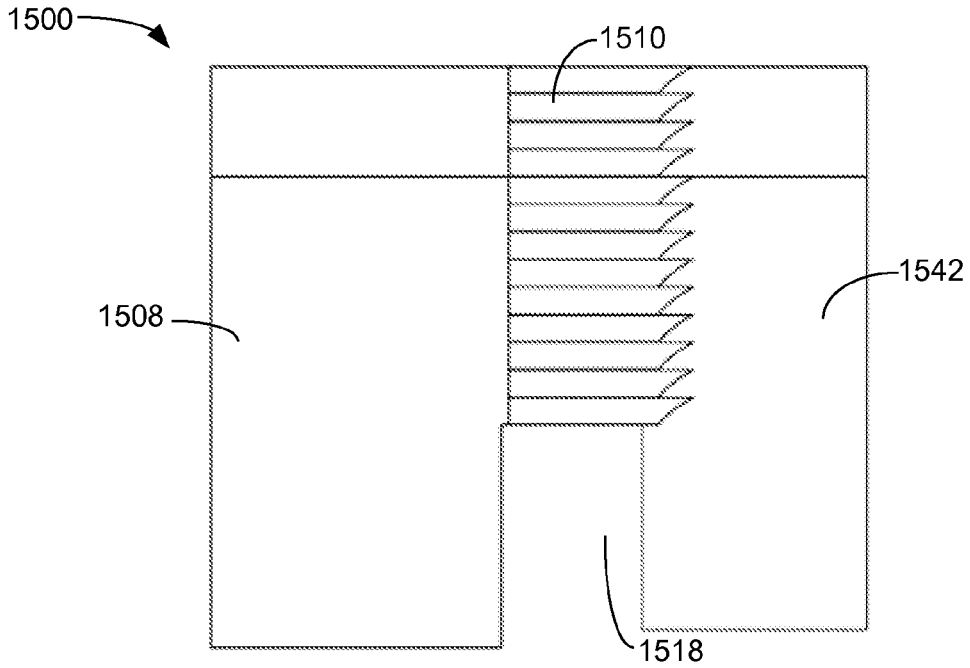
FIG. 16 is a side elevation view illustrating the exemplary third embodiment of a flip dog of FIG. 16, according to a preferred embodiment of the present invention.

FIG. 16 is a side elevation view illustrating the exemplary third embodiment of a dog 1500 of FIG. 15, according to a preferred embodiment of the present invention. The relocation of the ratchet teeth 1510 can be more clearly seen.

Figure 17:
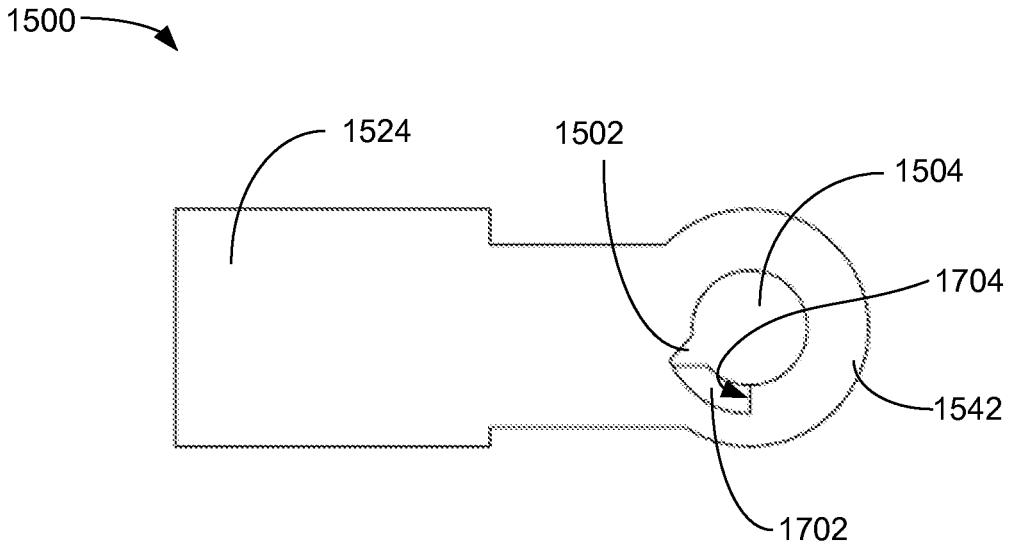
FIG. 17 is a top plan view illustrating the exemplary third embodiment of a flip dog of FIG. 16, according to a preferred embodiment of the present invention.

FIG. 17 is a top plan view illustrating the exemplary third embodiment of a flip dog 1500 of FIG. 15, according to a preferred embodiment of the present invention. A partial helical surface 1702 engages a bottom surface of key 1902 (see FIG. 19) as actuator 1900 is rotated to engage a side surface of key 1902 with surface 1704 for applying torque to dog 1500.

Figure 18:
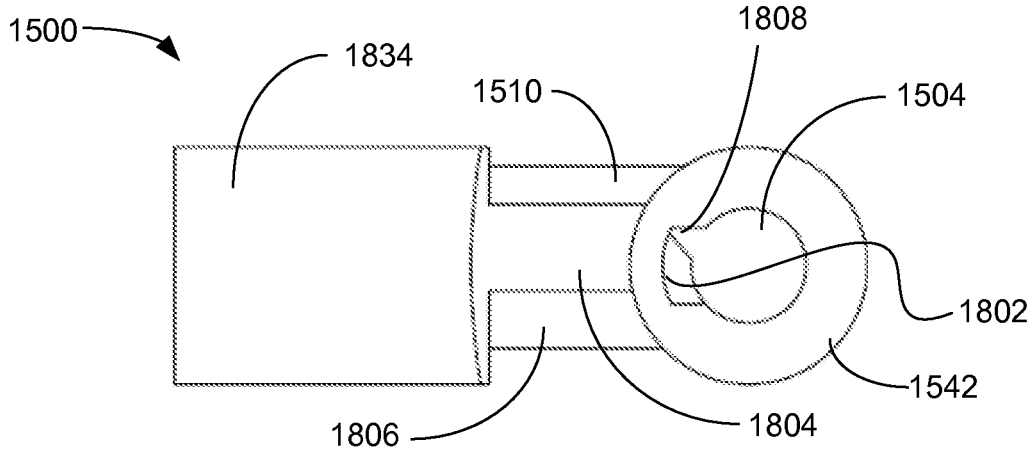
FIG. 18 is a bottom plan view illustrating the exemplary third embodiment of a flip dog of FIG. 16, according to a preferred embodiment of the present invention.

FIG. 18 is a bottom plan view illustrating the exemplary third embodiment of a flip dog 1500 of FIG. 15, according to a preferred embodiment of the present invention. The entry portion of the partial helical surface 1802, which guides the key 1902 as push rod is inserted into barrel hole 1504 during can be seen in groove 1808. The underside 1804 of the bridge 1506 extends from the barrel 1542 to the foot 1834 and supports ratchet teeth 1510 on a first side and a smooth engagement surface 1806 on the opposing side of the bridge 1506.

Figure 19:
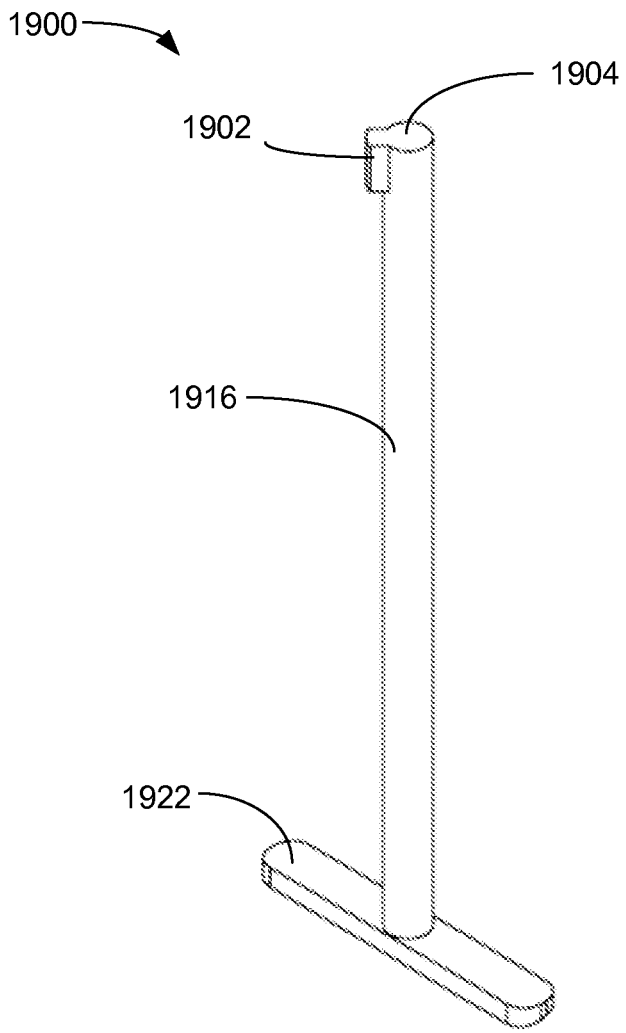
FIG. 19 is a front-top perspective view illustrating an exemplary embodiment of a removable pull rod, according to a preferred embodiment of the present invention.

FIG. 19 is a front-top perspective view illustrating an exemplary embodiment of a removable pull rod 1900, according to a preferred embodiment of the present invention. Actuator 1900 has an elongated right circular cylindrical shaft 1916 with opposing first and second ends. The first end has a T-handle 1922 and the second end has a flat surface 1904 that extends over the top surface of a key 1902 that is attached to or integral to a side portion of shaft 1916, as shown. Key 1902 is shaped generally as a rectangular solid, but the invention is not so limited. In operation, key 1902 is aligned with groove 1808 and inserted into barrel hole 1504 until the key reaches the top of groove 1502. Depending on the particular embodiment of flip dog mountable ceiling speaker enclosure, either torque may be applied to rotate the flip dog 1500 or a downward pull on the T-handle 1922 will engage the bottom surface of the key 1902 to the inner helical surface 1704 to 1802, causing rotation of the flip dog 1500 as the pull rod 1900 is withdrawn without rotating T-handle 1922.

Figure 20:
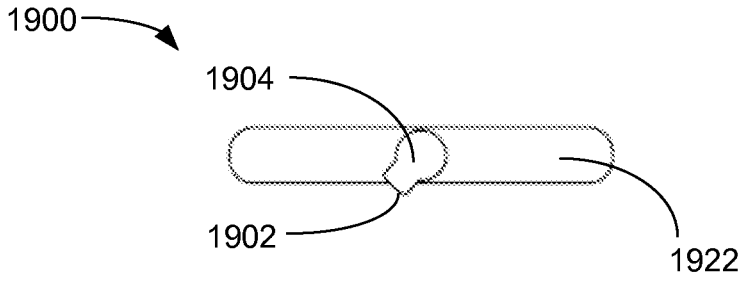
FIG. 20 is a top plan view illustrating the exemplary embodiment of the removable pull rod of FIG. 19, according to a preferred embodiment of the present invention.

FIG. 20 is a top plan view illustrating the exemplary embodiment of the removable pull rod 1900 of FIG. 19, according to a preferred embodiment of the present invention. The axis of the key 1902 is formed at an approximately forty-five degree angle to the long axis of the T-handle 1922. The angle determines the T-handle 1933 orientation at insertion. Depending on the embodiment of the flip dog mountable ceiling speaker enclosure and the installation environment, other angles may be chosen.

Figure 21:
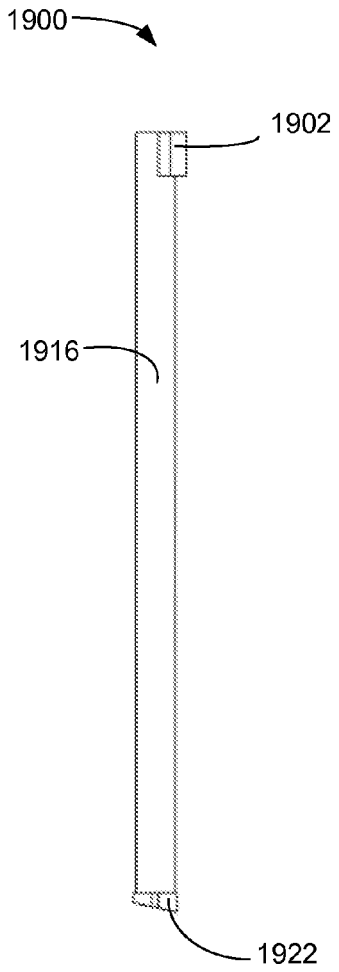
FIG. 21 is a left side elevation view illustrating the exemplary embodiment of the removable pull rod of FIG. 19, according to a preferred embodiment of the present invention.

FIG. 21 is a left side elevation view illustrating the exemplary embodiment of the removable pull rod 1900 of FIG. 19, according to a preferred embodiment of the present invention. This view is provided for enablement.

Figure 22:
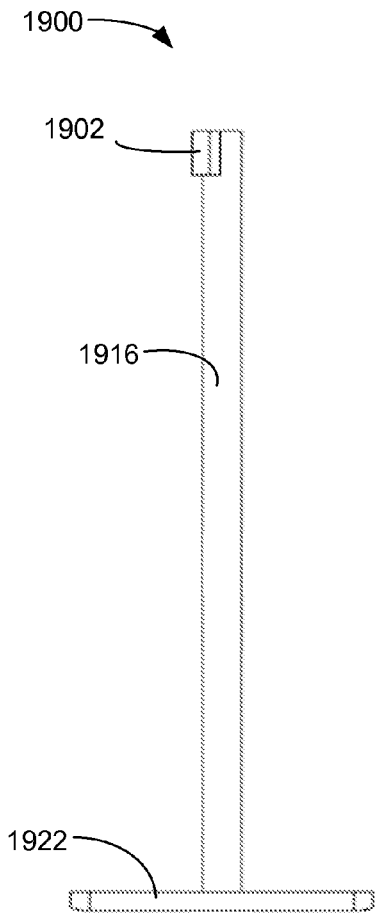
FIG. 22 is a front side elevation view illustrating the exemplary embodiment of the removable pull rod of FIG. 19, according to a preferred embodiment of the present invention.

FIG. 22 is a front side elevation view illustrating the exemplary embodiment of the removable pull rod 1900 of FIG. 19, according to a preferred embodiment of the present invention. This view is provided for enablement.

Figure 23:
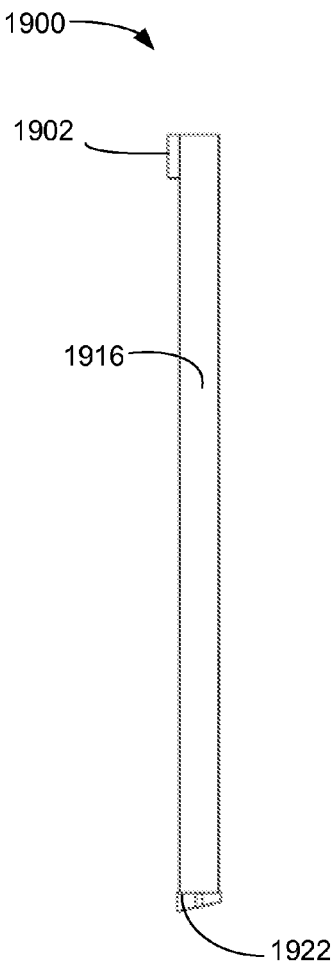
FIG. 23 is a right side elevation view illustrating the exemplary embodiment of the removable pull rod of FIG. 19, according to a preferred embodiment of the present invention.

FIG. 23 is a right side elevation view illustrating the exemplary embodiment of the removable pull rod 1900 of FIG. 19, according to a preferred embodiment of the present invention. This view is provided for enablement.

Although applicant has described applicant's preferred embodiments of this invention, it will be understood that the broadest scope of this invention includes such modifications as diverse shapes and sizes and materials. Such scope is limited only by the above specification and the claims below.

Further, many other advantages of applicant's invention will be apparent to those skilled in the art from the above descriptions.

We claim:

1. A manually mountable ceiling speaker enclosure, comprising:

a. a speaker enclosure comprising an output end;

b. a perimetrical support flange extending outwardly and perpendicularly from said output end;

c. a plurality of flip dogs mounted on and spaced apart along said perimetrical support flange proximate said speaker enclosure;

d. wherein each said flip dog has a dog having a first position tangent to said speaker enclosure and a second position radial to said speaker enclosure and wherein said first position is distal said perimetrical support flange and said second position is proximal said perimetrical support flange; and e. a manual actuator manipulatable, without tools, to move said dog from said first position to said second position.

2. The manually mountable ceiling speaker enclosure of claim 1, wherein said actuator may be operated by pulling said actuator away from said speaker enclosure.

3. The manually mountable ceiling speaker enclosure of claim 1, wherein said actuator may be operated by rotating said actuator.

4. The manually mountable ceiling speaker enclosure of claim 1, wherein said actuator may be releasable from said manually mountable ceiling speaker enclosure.

5. The manually mountable ceiling speaker enclosure of claim 1, wherein each dog of said plurality of flip dogs comprises:

a. a barrel for receiving at least a portion of said actuator;

b. an engagement device proximate a top of said barrel for engaging an end of said actuator;

c. a side-facing first ratchet portion comprising a linear array of upwardly pointed teeth extending from a middle portion of said barrel on a first side of said dog;

d. a bridge portion extending from said barrel above said first ratchet portion; and e. a foot extending from a distal end of said bridge portion and forming a notch between said first ratchet portion and said foot.

6. The manually mountable ceiling speaker enclosure of claim 5, comprising a perimetrical wall:

a. extending axially from said perimetrical support flange between said plurality of flip dogs and spaced apart from an outer perimeter of said perimetrical support flange;

b. configured to fit within said notch when said dog is in said second position; and c. defining a perimeter for an installation opening in a ceiling panel.

7. The manually mountable ceiling speaker enclosure of claim 1, wherein each flip dog of said plurality of flip dogs comprises:

a. first and second spaced apart and opposed sidewalls configured to engage respective said first side and a second opposed side of said dog when said dog is in said second position;

b. wherein said first sidewall comprises a second ratchet portion comprising a linear array of downwardly pointed teeth configured to:
   i. slidingly engage said barrel when said dog is in said first position and
   ii. ratchetly engage said first ratchet portion when said dog is moved into said second position; and
c. wherein said first sidewall comprises a recess above said second ratchet portion to avoid engagement of said first ratchet teeth during rotation of said dog;
d. wherein said second sidewall comprises a surface to slidingly engage said second side of said dog when said dog is moved into said second position.

8. The manually mountable ceiling speaker enclosure of claim 7, wherein said second wall supports a biasing member operable to urge said dog towards said second ratchet portion when said dog is moved into said second position.

9. The manually mountable ceiling speaker enclosure of claim 8, wherein said biasing member is releasably supported and each said flip dog further comprises a tool sleeve aligned to a release member of said releasably supported biasing member and configured to receive a tool for actuating said release member.

10. The manually mountable ceiling speaker enclosure of claim 7, wherein said second wall comprises an arcuate top surface for engaging a portion of a bottom surface of said dog in said first position and operable to urge said dog into rotation responsive to a downward force.

11. The manually mountable ceiling speaker enclosure of claim 7, further comprising first and second supports operable to buttress said first and second sidewalls, respectively.

12. The manually mountable ceiling speaker enclosure of claim 7, further comprising a rear arcuate wall extending between said first and second sidewalls, and having an inner curvature conformal to said barrel.

13. The manually mountable ceiling speaker enclosure of claim 1, comprising at least one of a loudspeaker and a trim ring.

14. A manually mountable ceiling speaker enclosure, comprising:
a. a speaker enclosure having an output end;
b. a perimetrical support flange extending outwardly and perpendicularly from said output end;
c. a plurality of flip dogs mounted on and spaced apart along said perimetrical support flange proximate said speaker enclosure;
d. wherein each said flip dog comprises a dog having a first position tangent to said speaker enclosure and a second position radial to said speaker enclosure and wherein said first position is distal said perimetrical support flange and said second position is proximal said perimetrical support flange; and
e. a manual actuator manipulatable, without tools, to move said dog from said first position to said second position; and
f. wherein said actuator may be manually operated by at least one of:
   i. pulling said actuator away from said speaker enclosure; and
   ii. rotating said actuator.

15. The manually mountable ceiling speaker enclosure of claim 14, wherein said actuator may be releasable from said manually mountable ceiling speaker enclosure.

16. The manually mountable ceiling speaker enclosure of claim 14, wherein each dog of said plurality of flip dogs comprises:
a. a barrel for receiving at least a portion of said actuator;
b. a side-facing first ratchet portion comprising a linear array of upwardly pointed teeth extending from a middle portion of said barrel on a first side of said dog;
c. a bridge portion extending from said barrel above said first ratchet portion; and
d. a foot extending from a distal end of said bridge portion and forming a notch between said first ratchet portion and said foot.

17. The manually mountable ceiling speaker enclosure of claim 16, comprising a perimetrical wall:
a. extending axially from said perimetrical support flange between said plurality of flip dogs and spaced apart from an outer perimeter of said perimetrical support flange;
b. configured to fit within said notch when said dog is in said second position; and
c. defining a perimeter for an installation opening in a ceiling panel.

18. The manually mountable ceiling speaker enclosure of claim 14, wherein each flip dog of said plurality of flip dogs comprises:
a. first and second spaced apart and opposed sidewalls configured to engage respective said first side and a second opposed side of said dog when said dog is in said second position;
b. wherein said first sidewall comprises a second ratchet portion comprising a linear array of downwardly pointed teeth configured to:
   i. slidingly engage said barrel when said dog is in said first position; and
   ii. ratchetly engage said first ratchet portion when said dog is moved into said second position; and
c. wherein said second wall:
   i. comprises a surface to slidingly engage said second side of said dog when said dog is moved into said second position;
   ii. supports a releasable biasing member operable to urge said dog towards said second ratchet portion when said dog is moved into said second position;
   iii. comprises a tool sleeve aligned to a release member of said releasably supported biasing member and configured to receive a tool for actuating said release member; and
   iv. comprises an arcuate top surface for engaging a portion of a bottom surface of said dog in said first position and operable to urge said dog into rotation responsive to a downward force;
d. first and second supports operable to buttress said first and second sidewalls, respectively; and
e. a rear arcuate wall extending between said first and second sidewalls, and having an inner curvature conformal to said barrel.

19. A manually mountable ceiling speaker enclosure, comprising:
a. a speaker enclosure having an output end;
b. a perimetrical support flange extending outwardly and perpendicularly from said output end;
c. a plurality of flip dogs mounted on and spaced apart on said perimetrical support flange proximate said speaker enclosure;
d. wherein each said flip dog further comprises a dog having a first position tangent to said speaker enclosure; and a second position radial to said speaker enclosure and wherein said first position is distal said perimetrical support flange and said second position is proximal said perimetrical support flange;
e. wherein each dog of said plurality of flip dogs comprises:
   i. a barrel for receiving at least a portion of said actuator;
   ii. a side-facing first ratchet portion comprising a linear array of upwardly pointed teeth extending from a middle portion of said barrel on a first side of said dog;

iii. a bridge extending from said barrel above said first ratchet portion; and iv. a foot extending from a distal end of said bridge and forming a notch between said first ratchet portion and said foot;

f. wherein each flip dog of said plurality of flip dogs comprises:

i. first and second spaced apart and opposed sidewalls configured to engage respective said first side and a second opposed side of said dog when said dog is in said second position;

ii. wherein said first sidewall comprises a second ratchet portion comprising a linear array of downwardly pointed teeth configured to:

1. slidingly engage said barrel when said dog is in said first position; and 2. ratchetly engage said first ratchet portion when said dog is moved into said second position; and iii. wherein said second wall:

1. comprises a surface to slidingly engage said second side of said dog when said dog is moved into said second position;

2. supports a releasable biasing member operable to urge said dog towards said second ratchet portion when said dog is moved into said second position;

3. comprises a tool sleeve aligned to a release member of said releasably supported biasing member and configured to receive a tool for actuating said release member;

4. comprises an arcuate top surface engaging a portion of a bottom surface of said dog in said first position and operable to urge said dog into rotation responsive to a downward force;

iv. first and second supports operable to buttress said first and second sidewalls, respectively;

v. a rear arcuate wall extending between said first and second sidewalls, and having an inner curvature conformal to said barrel;

g. a manual actuator manipulatable, without tools, to move said dog from said first position to said second position;

h. wherein said actuator may be manually operated by at least one of:

i. pulling said actuator away from said speaker enclosure; and ii. rotating said actuator; and i. a perimetrical wall:

i. extending axially from said perimetrical support flange between said plurality of flip dogs and spaced apart from an outer perimeter of said perimetrical support flange;

ii. configured to fit within said notch when said dog is in said second position; and iii. defining a perimeter for an installation opening in a ceiling panel.

20. The manually mountable ceiling speaker enclosure of claim 19, wherein said actuator may be releasable from said manually mountable ceiling speaker enclosure.

* * * * *